US010075802B1

(12) United States Patent
Kim et al.

(10) Patent No.: US 10,075,802 B1
(45) Date of Patent: Sep. 11, 2018

(54) BITRATE ALLOCATION FOR HIGHER ORDER AMBISONIC AUDIO DATA

(71) Applicant: QUALCOMM Incorporated, San Diego, CA (US)

(72) Inventors: Moo Young Kim, San Diego, CA (US); Nils Günther Peters, San Diego, CA (US); Jeongook Song, San Diego, CA (US); Dipanjan Sen, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 15/671,988

(22) Filed: Aug. 8, 2017

(51) Int. Cl.

| | |
|---|---|
| ***H04S 7/00*** | (2006.01) |
| ***G10L 25/21*** | (2013.01) |
| ***G10L 19/002*** | (2013.01) |
| ***G10L 19/008*** | (2013.01) |
| ***H04S 3/00*** | (2006.01) |

(52) U.S. Cl.
CPC ..... *H04S 7/302* (2013.01); *G10L 19/002* (2013.01); *G10L 19/008* (2013.01); *G10L 25/21* (2013.01); *H04S 3/008* (2013.01); *H04S 2400/13* (2013.01); *H04S 2420/11* (2013.01)

(58) Field of Classification Search
CPC ..... H04S 3/008; H04S 2420/11; H04H 20/89; H04H 60/07; G10L 19/167; G10L 19/008
USPC ..... 391/22, 23, 300, 303
See application file for complete search history.

(56) References Cited

U.S. PATENT DOCUMENTS

| | | | |
|---|---|---|---|
| 9,489,955 | B2 | 11/2016 | Peters et al. |
| 9,502,044 | B2 | 11/2016 | Peters et al. |
| 2014/0249827 | A1 | 9/2014 | Sen et al. |
| 2014/0358563 | A1 | 12/2014 | Sen et al. |

(Continued)

FOREIGN PATENT DOCUMENTS

| | | | |
|---|---|---|---|
| WO | 2015197516 | A1 | 12/2015 |
| WO | 2017036609 | A1 | 3/2017 |
| WO | 2017060412 | A1 | 4/2017 |

OTHER PUBLICATIONS

Bleidt, et al., "Object-Based Audio: Opportunities for Improved Listening Experience and Increased Listener Involvement," accessed on May 9, 2017, 20 pp.

(Continued)

*Primary Examiner* — Melur Ramakrishnaiah
(74) *Attorney, Agent, or Firm* — Shumaker & Sieffert, P.A.

(57) ABSTRACT

In general, techniques are described by which to perform bitrate allocation with respect to higher order ambisonic (HOA) audio data. A device comprising a memory and a processor may be configured to perform various aspects of the bitrate allocation techniques. The memory may be configured to store a spatially compressed version of the HOA audio data. The processor may be coupled to the memory, and configured to perform bitrate allocation, based on an analysis of transport channels representative of the spatially compressed version of the HOA audio data, and prior to performing gain control with respect to the transport channels or after performing inverse gain control with respect to the transport channels, to allocate a number of bits to each of the transport channels. The processor may also be configured to generate a bitstream that specifies each of the transport channels using the respective allocated number of bits.

30 Claims, 19 Drawing Sheets

(56) References Cited

U.S. PATENT DOCUMENTS

2015/0332682 A1* 11/2015 Kim ..... G10L 19/008 381/22
2015/0340044 A1* 11/2015 Kim ..... G10L 19/002 381/23
2016/0064005 A1* 3/2016 Peters ..... H04S 3/008 381/23

OTHER PUBLICATIONS

Najafzadeh, et al., "Perceptual Bit Allocation for Low Rate Coding of Narrowband Audio," Proc. IEEE Int. Conf. Acoustics, Speech, Signal Processing (Istanbul), Jun. 2000, pp. 893-896.
ISO/IEC DIS 23008-3 Information Technology—High efficiency coding and media delivery in heterogeneous environments—Part 3: 3D audio, Jul. 25, 2014, XP055205625, 433 pp.
"Information technology—High efficiency coding and media delivery in heterogeneous environments—Part 3: Part 3: 3D Audio, Amendment 3: MPEG-H 3D Audio Phase 2," ISO/IEC JTC 1/SC 29N, ISO/IEC 23008-3:2015/PDAM 3, Jul. 25, 2015, 208 pp.
Poletti, "Three-Dimensional Surround Sound Systems Based on Spherical Harmonics," J. Audio Eng. Soc., vol. 53, No. 11, Nov. 2005, pp. 1004-1025.
Hellerud, et al., "Spatial redundancy in Higher Order Ambisonics and its use for lowdelay lossless compression", Acoustics, Speech and Signal Processing, 2009, ICASSP 2009, IEEE International Conference on, IEEE, Piscataway, NJ, USA, Apr. 19, 2009, XP031459218, pp. 269-272.
"Call for Proposals for 3D Audio," ISO/IEC JTC1/SC29/WG11/N13411, Jan. 2013, 20 pp.
Herre, et al., "MPEG-H 3D Audio—The New Standard for Coding of Immersive Spatial Audio," IEEE Journal of Selected Topics in Signal Processing, vol. 9, No. 5, Aug. 2015, pp. 770-779.
"Information technology—High efficiency coding and media delivery in heterogeneous environments—Part 3: Part 3: 3D Audio, Amendment 3: MPEG-H 3D Audio Phase 2," ISO/IEC JTC 1/SC 29N, Jul. 25, 2015, 208 pp.
"Information technology—High efficiency coding and media delivery in heterogeneous environments—Part 3: 3D Audio," ISO/IEC JTC 1/SC 29N, Apr. 4, 2014, 337 pp.
"Information technology—High efficiency coding and media delivery in heterogeneous environments—Part 3: 3D Audio," ISO/IEC JTC 1/SC 29, Jul. 25, 2014, 433 pp.
"Information technology—High efficiency coding and media delivery in heterogeneous environments—Part 3: 3D Audio," ISO/IEC JTC 1/SC 29, Jul. 25, 2014, 311 pp.
Hellerud, et al., "Encoding higher order ambisonics with AAC," Audio Engineering Society—124th Audio Engineering Society Convention 2008, XP040508582, May 2008, 8 pp.

* cited by examiner

BITRATE ALLOCATION FOR HIGHER ORDER AMBISONIC AUDIO DATA

TECHNICAL FIELD

This disclosure relates to audio data and, more specifically, compression of audio data.

BACKGROUND

A higher order ambisonic (HOA) signal (often represented by a plurality of spherical harmonic coefficients (SHC) or other hierarchical elements) is a three-dimensional (3D) representation of a soundfield. The HOA representation may represent this soundfield in a manner that is independent of the local speaker geometry used to playback a multi-channel audio signal rendered from this HOA signal. The HOA signal may also facilitate backwards compatibility as the HOA signal may be rendered to well-known and highly adopted multi-channel formats, such as a 5.1 audio channel format or a 7.1 audio channel format. The HOA representation may therefore enable a better representation of a soundfield that also accommodates backward compatibility.

SUMMARY

In general, techniques are described for compression of higher-order ambisonic audio data. Higher-order ambisonic audio data may comprise at least one spherical harmonic coefficient corresponding to a spherical harmonic basis function having an order greater than one.

In one example, a device configured to compress higher-order ambisonic (HOA) audio data representative of a soundfield comprises a memory configured to store a spatially compressed version of the HOA audio data. The device also comprises one or more processors coupled to the memory, and configured to perform bitrate allocation, based on an analysis of transport channels representative of the spatially compressed version of the HOA audio data, and prior to performing gain control with respect to the transport channels or after performing inverse gain control with respect to the transport channels, to allocate a number of bits to each of the transport channels, and generate a bitstream that specifies each of the transport channels using the respective allocated number of bits.

In another example, a method to compress higher-order ambisonic (HOA) audio data representative of a soundfield comprises performing bitrate allocation, based on an analysis of transport channels representative of a spatially compressed version of the HOA audio data, and prior to performing gain control with respect to the transport channels or after performing inverse gain control with respect to the transport channels, to allocate a number of bits to each of the transport channels, and generating a bitstream that specifies each of the transport channels using the respective allocated number of bits.

In another example, a non-transitory computer-readable storage medium has stored thereon instructions that, when executed, cause one or more processors to perform bitrate allocation, based on an analysis of transport channels representative of a spatially compressed version of higher-order ambisonic (HOA) audio data, and prior to performing gain control with respect to the transport channels or after performing inverse gain control with respect to the transport channels, to allocate a number of bits to each of the transport channels, and generate a bitstream that specifies each of the transport channels using the respective allocated number of bits.

In another example, a device configured to compress higher-order ambisonic (HOA) audio data representative of a soundfield comprises means for performing bitrate allocation, based on an analysis of transport channels representative of a spatially compressed version of the HOA audio data, and prior to performing gain control with respect to the transport channels or after performing inverse gain control with respect to the transport channels, to allocate a number of bits to each of the transport channels, and means for generating a bitstream that specifies each of the transport channels using the respective allocated number of bits.

The details of one or more aspects of the techniques are set forth in the accompanying drawings and the description below. Other features, objects, and advantages of these techniques will be apparent from the description and drawings, and from the claims.

DETAILED DESCRIPTION

There are various 'surround-sound' channel-based formats in the market. They range, for example, from the 5.1 home theatre system (which has been the most successful in terms of making inroads into living rooms beyond stereo) to the 22.2 system developed by NHK (Nippon Hoso Kyokai or Japan Broadcasting Corporation). Content creators (e.g., Hollywood studios) would like to produce the soundtrack for a movie once, and not spend effort to remix it for each speaker configuration. A Moving Pictures Expert Group (MPEG) has released a standard allowing for soundfields to be represented using a hierarchical set of elements (e.g., Higher-Order Ambisonic-HOA-coefficients) that can be rendered to speaker feeds for most speaker configurations, including 5.1 and 22.2 configuration whether in location defined by various standards or in non-uniform locations.

MPEG released the standard as MPEG-H 3D Audio standard, formally entitled "Information technology-High efficiency coding and media delivery in heterogeneous environments-Part 3: 3D audio," set forth by ISO/IEC JTC 1/SC 29, with document identifier ISO/IEC DIS 23008-3, and dated Jul. 25, 2014. MPEG also released a second edition of the 3D Audio standard, entitled "Information technology-High efficiency coding and media delivery in heterogeneous environments-Part 3: 3D audio, set forth by ISO/IEC JTC 1/SC 29, with document identifier ISO/IEC 23008-3:201x (E), and dated Oct. 12, 2016. Reference to the "3D Audio standard" in this disclosure may refer to one or both of the above standards.

As noted above, one example of a hierarchical set of elements is a set of spherical harmonic coefficients (SHC). The following expression demonstrates a description or representation of a soundfield using SHC:

$$p_i(t, r_r, \theta_r, \varphi_r) = \sum_{\omega=0}^{\infty}\left[4\pi\sum_{n=0}^{\infty} j_n(kr_r)\sum_{m=-n}^{n} A_n^m(k)Y_n^m(\theta_r, \varphi_r)\right]e^{j\omega t},$$

The expression shows that the pressure $p_i$ at any point $\{r_r, \theta_r, \varphi_r\}$ of the soundfield, at time t, can be represented uniquely by the SHC, $A_n^m(k)$. Here, k=w/c, c is the speed of sound (~343 m/s), $\{r_r, \theta_r, \varphi_r\}$ is a point of reference (or observation point), $j_n(\bullet)$ is the spherical Bessel function of order n, and $Y_n^m(\theta_r, \varphi_r)$ are the spherical harmonic basis functions (which may also be referred to as a spherical basis function) of order n and suborder m. It can be recognized that the term in square brackets is a frequency-domain representation of the signal (i.e., $S(\omega, r_r, \theta_r, \varphi_r)$) which can be approximated by various time-frequency transformations, such as the discrete Fourier transform (DFT), the discrete cosine transform (DCT), or a wavelet transform. Other examples of hierarchical sets include sets of wavelet transform coefficients and other sets of coefficients of multiresolution basis functions.

Figure 1:
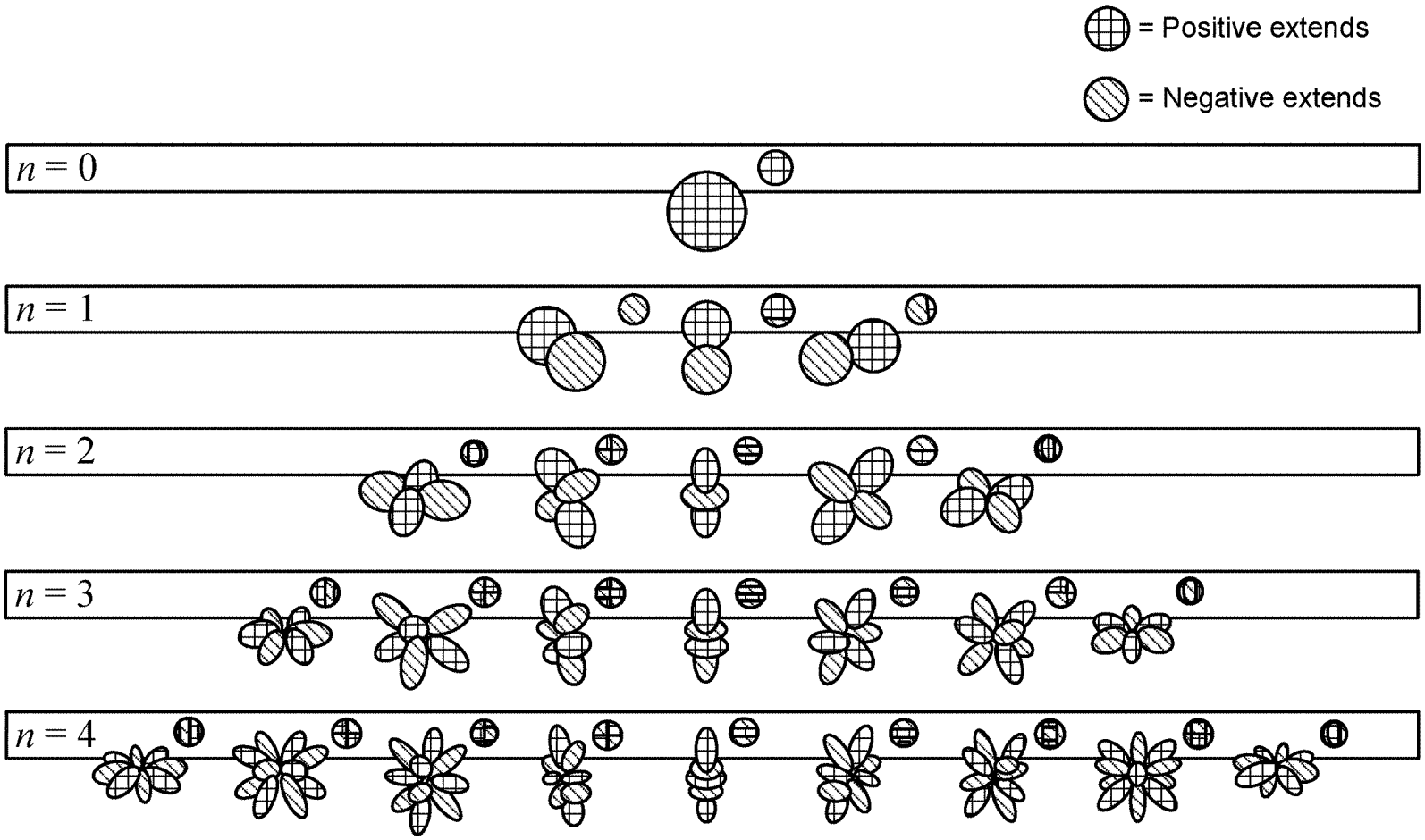
FIG. 1 is a diagram illustrating spherical harmonic basis functions of various orders and sub-orders.

FIG. 1 is a diagram illustrating spherical harmonic basis functions from the zero order (n=0) to the fourth order (n=4). As can be seen, for each order, there is an expansion of suborders m which are shown but not explicitly noted in the example of FIG. 1 for ease of illustration purposes.

The SHC $A_n^m(k)$ can either be physically acquired (e.g., recorded) by various microphone array configurations or, alternatively, they can be derived from channel-based or object-based descriptions of the soundfield. The SHC (which also may be referred to as higher order ambisonic-HOA-coefficients) represent scene-based audio, where the SHC may be input to an audio encoder to obtain encoded SHC that may promote more efficient transmission or storage. For example, a fourth-order representation involving $(1+4)^2$ (25, and hence fourth order) coefficients may be used.

As noted above, the SHC may be derived from a microphone recording using a microphone array. Various examples of how SHC may be derived from microphone arrays are described in Poletti, M., "Three-Dimensional Surround Sound Systems Based on Spherical Harmonics," J. Audio Eng. Soc., Vol. 53, No. 11, 2005 November, pp. 1004-1025.

To illustrate how the SHCs may be derived from an object-based description, consider the following equation. The coefficients $A_n^m(k)$ for the soundfield corresponding to an individual audio object may be expressed as:

$$A_n^m(k)=g(\omega)(-4\pi ik)h_n^{(2)}(kr_s)Y_n^{m*}(\theta_s,\varphi_s),$$

where i is, $\sqrt{-1}$, $h_n^{(2)}(\bullet)$ is the spherical Hankel function (of the second kind) of order n, and $\{r_s, \theta_s, \varphi_s\}$ is the location of the object. Knowing the object source energy $g(\omega)$ as a function of frequency (e.g., using time-frequency analysis techniques, such as performing a fast Fourier transform on the PCM stream) allows us to convert each PCM object and the corresponding location into the SHC $A_n^m(k)$. Further, it can be shown (since the above is a linear and orthogonal decomposition) that the $A_n^m(k)$ coefficients for each object are additive. In this manner, a number of PCM objects can be represented by the $A_n^m(k)$ coefficients (e.g., as a sum of the coefficient vectors for the individual objects). Essentially, the coefficients contain information about the soundfield (the pressure as a function of 3D coordinates), and the above represents the transformation from individual objects to a representation of the overall soundfield, in the vicinity of the observation point $\{r_r, \theta_r, \varphi_r\}$. The remaining figures are described below in the context of SHC-based audio coding.

Figure 2:
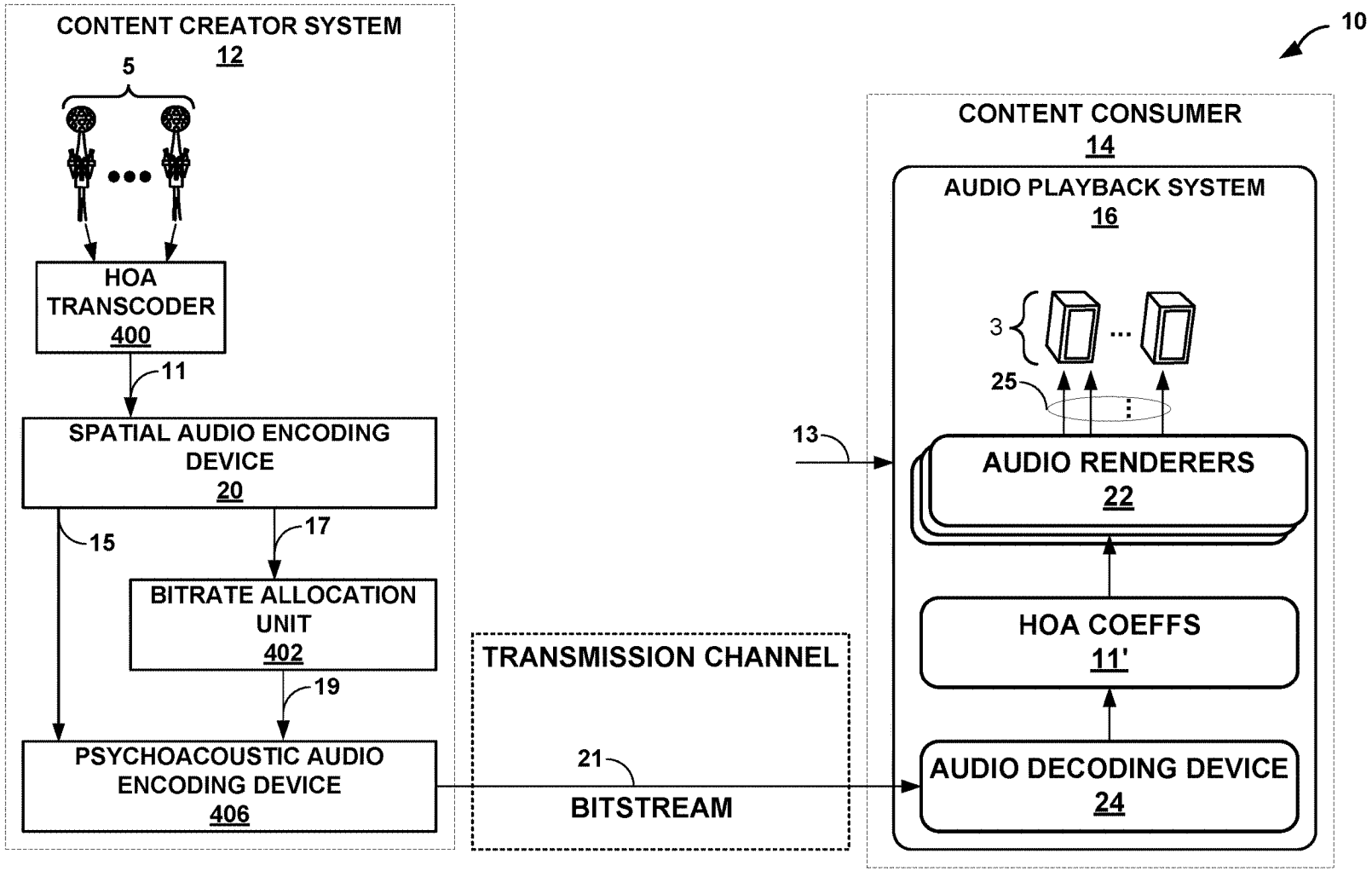
FIG. 2 is a diagram illustrating a system that may perform various aspects of the techniques described in this disclosure.

FIG. 2 is a diagram illustrating a system 10 that may perform various aspects of the techniques described in this disclosure. As shown in the example of FIG. 2, the system 10 includes a content creator system 12 and a content consumer 14. While described in the context of the content creator system 12 and the content consumer 14, the techniques may be implemented in any context in which SHCs (which may also be referred to as HOA coefficients) or any other hierarchical representation of a soundfield are encoded to form a bitstream representative of the audio data. Moreover, the content creator system 12 may represent a system comprising one or more of any form of computing devices capable of implementing the techniques described in this disclosure, including a handset (or cellular phone, including a so-called "smart phone"), a tablet computer, a laptop computer, a desktop computer, or dedicated hardware to provide a few examples or. Likewise, the content consumer 14 may represent any form of computing device capable of implementing the techniques described in this disclosure, including a handset (or cellular phone, including a so-called "smart phone"), a tablet computer, a television, a set-top box, a laptop computer, a gaming system or console, or a desktop computer to provide a few examples.

The content creator network 12 may represent any entity that may generate multi-channel audio content and possibly video content for consumption by content consumers, such as the content consumer 14. The content creator system 12 may capture live audio data at events, such as sporting events, while also inserting various other types of additional audio data, such as commentary audio data, commercial audio data, intro or exit audio data and the like, into the live audio content.

The content consumer 14 represents an individual that owns or has access to an audio playback system, which may refer to any form of audio playback system capable of rendering higher order ambisonic audio data (which includes higher order audio coefficients that, again, may also be referred to as spherical harmonic coefficients) to speaker feeds for play back as so-called "multi-channel audio content." The higher-order ambisonic audio data may be defined in the spherical harmonic domain and rendered or otherwise transformed from the spherical harmonic domain to a spatial domain, resulting in the multi-channel audio content in the form of one or more speaker feeds. In the example of FIG. 2, the content consumer 14 includes an audio playback system 16.

The content creator system 12 includes microphones 5 that record or otherwise obtain live recordings in various formats (including directly as HOA coefficients) and audio objects. When the microphone array 5 (which may also be referred to as "microphones 5") obtains live audio directly as HOA coefficients, the microphones 5 may include an HOA transcoder, such as an HOA transcoder 400 shown in the example of FIG. 2. In other words, although shown as separate from the microphones 5, a separate instance of the HOA transcoder 400 may be included within each of the microphones 5 so as to naturally transcode the captured feeds into the HOA coefficients 11. However, when not included within the microphones 5, the HOA transcoder 400 may transcode the live feeds output from the microphones 5 into the HOA coefficients 11. In this respect, the HOA transcoder 400 may represent a unit configured to transcode microphone feeds and/or audio objects into the HOA coefficients 11. The content creator system 12 therefore includes the HOA transcoder 400 as integrated with the microphones 5, as an HOA transcoder separate from the microphones 5 or some combination thereof.

The content creator system 12 may also include a spatial audio encoding device 20, a bitrate allocation unit 402, and a psychoacoustic audio encoding device 406. The spatial audio encoding device 20 may represent a device capable of performing the compression techniques described in this disclosure with respect to the HOA coefficients 11 to obtain intermediately formatted audio data 15 (which may also be referred to as "mezzanine formatted audio data 15" when the content creator system 12 represents a broadcast network as described in more detail below). Intermediately formatted audio data 15 may represent audio data that is compressed using the spatial audio compression techniques but that has not yet undergone psychoacoustic audio encoding (e.g., such as advanced audio coding—AAC, or other similar types of psychoacoustic audio encoding). Although described in more detail below, the spatial audio encoding device 20 may be configured to perform this intermediate compression with respect to the HOA coefficients 11 by performing, at least in part, a decomposition (such as a linear decomposition described in more detail below) with respect to the HOA coefficients 11.

The spatial audio encoding device 20 may be configured to compress the HOA coefficients 11 using a decomposition involving application of a linear invertible transform (LIT). One example of the linear invertible transform is referred to as a "singular value decomposition" (or "SVD"), which may represent one form of a linear decomposition. In this example, the spatial audio encoding device 20 may apply SVD to the HOA coefficients 11 to determine a decomposed version of the HOA coefficients 11. The decomposed version of the HOA coefficients 11 may include one or more of predominant audio signals and one or more corresponding spatial components describing a direction, shape, and width of the associated predominant audio signals. The spatial audio encoding device 20 may analyze the decomposed version of the HOA coefficients 11 to identify various parameters, which may facilitate reordering of the decomposed version of the HOA coefficients 11.

The spatial audio encoding device 20 may reorder the decomposed version of the HOA coefficients 11 based on the identified parameters, where such reordering, as described in further detail below, may improve coding efficiency given that the transformation may reorder the HOA coefficients across frames of the HOA coefficients (where a frame commonly includes M samples of the decomposed version of the HOA coefficients 11 and M is, in some examples, set to 1024). After reordering the decomposed version of the HOA coefficients 11, the spatial audio encoding device 20 may select those of the decomposed version of the HOA coefficients 11 representative of foreground (or, in other words, distinct, predominant or salient) components of the soundfield. The spatial audio encoding device 20 may specify the decomposed version of the HOA coefficients 11 representative of the foreground components as an audio object (which may also be referred to as a "predominant sound signal," or a "predominant sound component") and associated directional information (which may also be referred to as a "spatial component" or, in some instances, as a so-called "V-vector").

The spatial audio encoding device 20 may next perform a soundfield analysis with respect to the HOA coefficients 11 in order to, at least in part, identify the HOA coefficients 11 representative of one or more background (or, in other words, ambient) components of the soundfield. The spatial audio encoding device 20 may perform energy compensation with respect to the background components given that, in some examples, the background components may only include a subset of any given sample of the HOA coefficients 11 (e.g., such as those corresponding to zero and first order spherical basis functions and not those corresponding to second or higher order spherical basis functions). When order-reduction is performed, in other words, the spatial audio encoding device 20 may augment (e.g., add/subtract energy to/from) the remaining background HOA coefficients of the HOA coefficients 11 to compensate for the change in overall energy that results from performing the order reduction.

The spatial audio encoding device 20 may perform a form of interpolation with respect to the foreground directional information and then perform an order reduction with respect to the interpolated foreground directional information to generate order reduced foreground directional information. The spatial audio encoding device 20 may further perform, in some examples, a quantization with respect to the order reduced foreground directional information, outputting coded foreground directional information. In some instances, this quantization may comprise a scalar/entropy quantization. The spatial audio encoding device 20 may then output the intermediately formatted audio data 15 as the background components, the foreground audio objects, and the quantized directional information.

The background components and the foreground audio objects may comprise pulse code modulated (PCM) transport channels in some examples. That is, the spatial audio encoding device 20 may output a transport channel for each frame of the HOA coefficients 11 that includes a respective one of the background components (e.g., M samples of one of the HOA coefficients 11 corresponding to the zero or first order spherical basis function) and for each frame of the foreground audio objects (e.g., M samples of the audio objects decomposed from the HOA coefficients 11). The spatial audio encoding device 20 may further output side information (which may also be referred to as "sideband information") that includes the spatial components corresponding to each of the foreground audio objects. Collectively, the transport channels and the side information may be represented in the example of FIG. 1 as the intermediately formatted audio data 15. In other words, the intermediately formatted audio data 15 may include the transport channels and the side information.

The spatial audio encoding device 20 may then transmit or otherwise output the intermediately formatted audio data 15 to psychoacoustic audio encoding device 406. The psychoacoustic audio encoding device 406 may perform psychoacoustic audio encoding with respect to the intermediately formatted audio data 15 to generate a bitstream 21. The content creator system 12 may then transmit the bitstream 21 via a transmission channel to the content consumer 14.

In some examples, the psychoacoustic audio encoding device 406 may represent multiple instances of a psychoacoustic audio coder, each of which is used to encode a transport channel of the intermediately formatted audio data 15. In some instances, this psychoacoustic audio encoding device 406 may represent one or more instances of an advanced audio coding (AAC) encoding unit. The psychoacoustic audio coder unit 406 may, in some instances, invoke an instance of an AAC encoding unit for each transport channel of the intermediately formatted audio data 15.

More information regarding how the background spherical harmonic coefficients may be encoded using an AAC encoding unit can be found in a convention paper by Eric Hellerud, et al., entitled "Encoding Higher Order Ambisonics with AAC," presented at the 124$^{th}$ Convention, 2008 May 17-20 and available at: http://ro.uow.edu.au/cgi/viewcontent.cgi?article=8025&context=engpapers. In some instances, the psychoacoustic audio encoding device 406 may audio encode various transport channels (e.g., transport channels for the background HOA coefficients) of the intermediately formatted audio data 15 using a lower target bitrate than that used to encode other transport channels (e.g., transport channels for the foreground audio objects) of the intermediately formatted audio data 15.

While shown in FIG. 2 as being directly transmitted to the content consumer 14, the content creator system 12 may output the bitstream 21 to an intermediate device positioned between the content creator system 12 and the content consumer 14. The intermediate device may store the bitstream 21 for later delivery to the content consumer 14, which may request this bitstream. The intermediate device may comprise a file server, a web server, a desktop computer, a laptop computer, a tablet computer, a mobile phone, a smart phone, or any other device capable of storing the bitstream 21 for later retrieval by an audio decoder. The intermediate device may reside in a content delivery network capable of streaming the bitstream 21 (and possibly in conjunction with transmitting a corresponding video data bitstream) to subscribers, such as the content consumer 14, requesting the bitstream 21.

Alternatively, the content creator system 12 may store the bitstream 21 to a storage medium, such as a compact disc, a digital video disc, a high definition video disc or other storage media, most of which are capable of being read by a computer and therefore may be referred to as computer-readable storage media or non-transitory computer-readable storage media. In this context, the transmission channel may refer to those channels by which content stored to these mediums are transmitted (and may include retail stores and other store-based delivery mechanism). In any event, the techniques of this disclosure should not therefore be limited in this respect to the example of FIG. 2.

As further shown in the example of FIG. 2, the content consumer 14 includes the audio playback system 16. The audio playback system 16 may represent any audio playback system capable of playing back multi-channel audio data. The audio playback system 16 may include a number of different audio renderers 22. The audio renderers 22 may each provide for a different form of rendering, where the different forms of rendering may include one or more of the various ways of performing vector-base amplitude panning (VBAP), and/or one or more of the various ways of performing soundfield synthesis.

The audio playback system 16 may further include an audio decoding device 24. The audio decoding device 24 may represent a device configured to decode HOA coefficients 11' from the bitstream 21, where the HOA coefficients 11' may be similar to the HOA coefficients 11 but differ due to lossy operations (e.g., quantization) and/or transmission via the transmission channel.

That is, the audio decoding device 24 may dequantize the foreground directional information specified in the bitstream 21, while also performing psychoacoustic decoding with respect to the foreground audio objects specified in the bitstream 21 and the encoded HOA coefficients representative of background components. The audio decoding device 24 may further perform interpolation with respect to the decoded foreground directional information and then determine the HOA coefficients representative of the foreground components based on the decoded foreground audio objects and the interpolated foreground directional information. The audio decoding device 24 may then determine the HOA coefficients 11' based on the determined HOA coefficients representative of the foreground components and the decoded HOA coefficients representative of the background components.

The audio playback system 16 may, after decoding the bitstream 21 to obtain the HOA coefficients 11', render the HOA coefficients 11' to output speaker feeds 25. The audio playback system 15 may output speaker feeds 25 to one or more of speakers 3. The speaker feeds 25 may drive the speakers 3. The speakers 3 may represent loudspeakers (e.g., transducers placed in a cabinet or other housing), headphone speakers, or any other type of transducer capable of emitting sounds based on electrical signals.

To select the appropriate renderer or, in some instances, generate an appropriate renderer, the audio playback system 16 may obtain loudspeaker information 13 indicative of a number of the speakers 3 and/or a spatial geometry of the speakers 3. In some instances, the audio playback system 16 may obtain the loudspeaker information 13 using a reference microphone and driving the speakers 3 in such a manner as to dynamically determine the speaker information 13. In other instances or in conjunction with the dynamic determination of the speaker information 13, the audio playback system 16 may prompt a user to interface with the audio playback system 16 and input the speaker information 13.

The audio playback system 16 may select one of the audio renderers 22 based on the speaker information 13. In some instances, the audio playback system 16 may, when none of the audio renderers 22 are within some threshold similarity measure (in terms of the loudspeaker geometry) to that specified in the speaker information 13, generate the one of audio renderers 22 based on the speaker information 13. The audio playback system 16 may, in some instances, generate the one of audio renderers 22 based on the speaker information 13 without first attempting to select an existing one of the audio renderers 22.

While described with respect to speaker feeds 25, the audio playback system 16 may render headphone feeds from either the speaker feeds 25 or directly from the HOA coefficients 11', outputting the headphone feeds to headphone speakers. The headphone feeds may represent binaural audio speaker feeds, which the audio playback system 15 renders using a binaural audio renderer.

The spatial audio encoding device 20 may encode (or, in other words, compress) the HOA audio data into a variable number of transport channels, each of which is allocated some amount of the bitrate using various bitrate allocation mechanisms. One example bitrate allocation mechanism allocates an equal number of bits to each transport channel. Another example bitrate allocation mechanism allocates bits to each of the transport channels based on an energy associated with each transport channel after each of the transport channels undergo gain control to normalize the gain of each of the transport channels.

Figure 5:
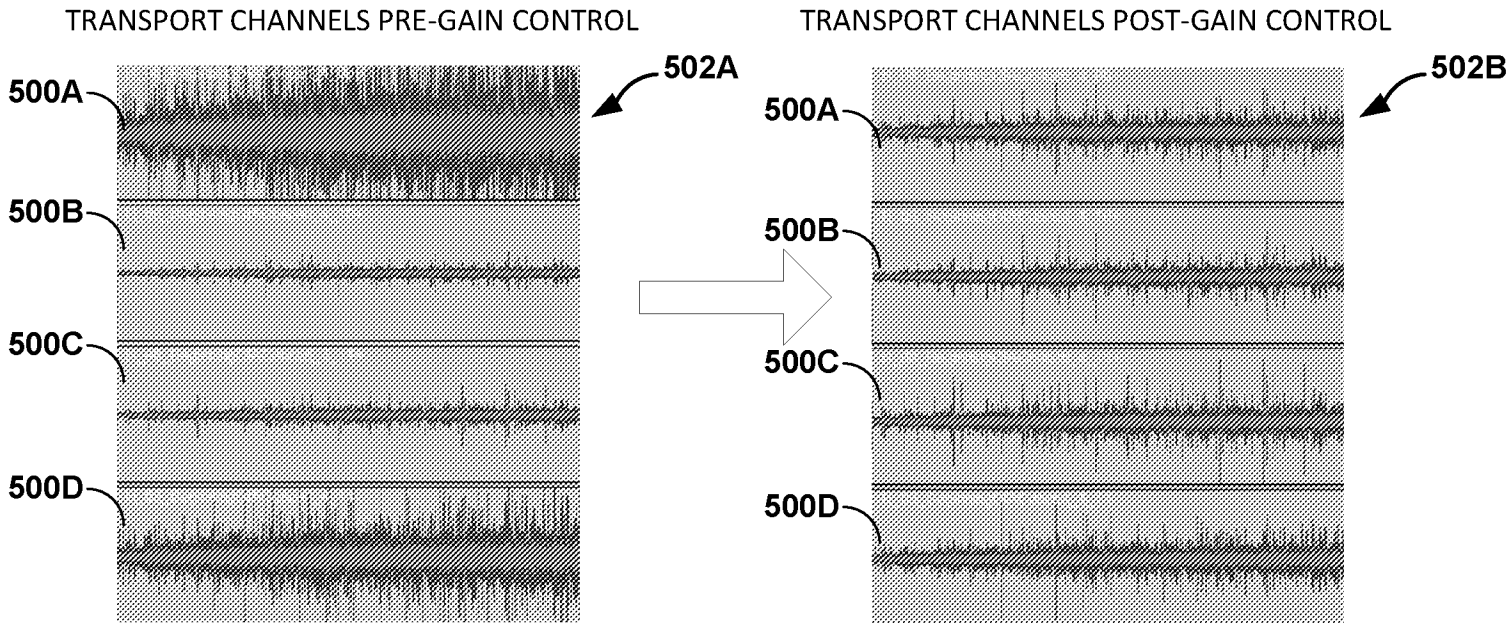
FIG. 5 is a diagram illustrating an example application of gain control to transport channels before and after application of gain control.

FIG. 5 is a diagram illustrating an example application of gain control to transport channels before and after application of gain control. Transport channels 500A-500D ("transport channels 500") may represent four of transport channels 17 discussed above. In plot 502A, the transport channels 500 have widely different gains, with the transport channels 500A and 500D having significantly higher gain levels than the transport channels 500B and 500C. In plot 502B, the transport channels 500 include normalized gain values, where the gain of transport channels 500 has been normalized through application of gain control to the transport channels 500 shown in the plot 502A.

Application of bitrate allocation mechanisms to the transport channels 500 shown in the plot 502B may result in a uniform (or nearly uniform) number of bits being allocated to each of the transport channels despite that the transport channels 500A and 500D may be more significant (in terms of gain) compared to the transport channels 500B and 500C. As a result, such bitrate allocation mechanisms may not allocate bits in a manner that preserves the fidelity of the soundfield represented by each of the transport channels, thereby impacting decoding and eventual playback through introduction of audio artifacts, reduced perception of some spatial directions within the soundfield, etc., In accordance with the techniques described in this disclosure, spatial audio encoding device 20 may provide transport channels 17 to the bitrate allocation unit 402 such that the bitrate allocation unit 402 may perform a number of different bitrate allocation mechanisms that may preserve the fidelity of the soundfield represented by each of transport channels. As such, the techniques may potentially avoid the introduction of audio artifacts while allowing for accurate perception of the soundfield from the various spatial directions.

The spatial audio encoding device 20 may output the transport channels 17 prior to performing gain control with respect to the transport channels 17. Alternatively, the spatial audio encoding device 20 may output the transport channels 17 after performing gain control, which the bitrate allocation unit 402 may undo through application of inverse gain control with respect to the transport channels 17 prior to performing one of the various bitrate allocation mechanisms.

In one example bitrate allocation mechanism, the bitrate allocation unit 402 may perform an energy analysis with respect to each of the transport channels 17 prior to application of gain control to normalize gain associated with each of the transport channels 17. Gain normalization may impact bitrate allocation as such normalization may result in each of the transport channels 17 being considered of equal importance (as energy is measured based, in large part, on gain). As such, performing energy-based bitrate allocation with respect to gain normalized transport channels 17 may result in nearly the same number of bits being allocated to each of the transport channels 17. Performing energy-based bitrate allocation with respect to the transport channels 17, prior to gain control (or after reversing gain control through application of inverse gain control to the transport channels 17), may thereby result in improved bitrate allocation that more accurately reflects the importance of each of the transport channels 17 in providing information relevant in describing the soundfield.

In another bitrate allocation mechanism, the bitrate allocation unit 402 may allocate bits to each of the transport channels 17 based on a spatial analysis of each of the transport channels 17. The bitrate allocation unit 402 may render each of the transport channels 17 to one or more spatial domain channels (which may be another way to refer to one or more loudspeaker feeds for a corresponding one or more loudspeakers at different spatial locations).

As an alternative to or in conjunction with the energy analysis, the bitrate allocation unit 402 may perform a perceptual entropy based analysis of the rendered spatial domain channels (for each of the transport channels 17) to identify to which of the transport channels 17 to allocate a respectively greater or lesser number of bits.

In some instances, the bitrate allocation unit 402 may supplement the perceptual entropy based analysis with a direction based weighting in which foregoing sounds are identified and allocated more bits relative to background sounds. The audio encoder may perform the direction based weighting and then perform the perceptual entropy based analysis to further refine the bit allocation to each of the transport channels 17.

In this respect, the bitrate allocation unit 402 may represent a unit configured to perform a bitrate allocation, based on an analysis (e.g., any combination of energy-based analysis, perceptual-based analysis, and/or directional-based weighting analysis) of transport channels 17 and prior to performing gain control with respect to the transport channels 17 or after performing inverse gain control with respect to the transport channels 17, to allocate bits to each of the transport channels 17. As a result of the bitrate allocation, the bitrate allocation unit 402 may determine a bitrate allocation schedule 19 indicative of a number of bits to be allocated to each of the transport channels 17. The bitrate allocation unit 402 may output the bitrate allocation schedule 19 to the psychoacoustic audio encoding device 406.

The psychoacoustic audio encoding device 406 may perform psychoacoustic audio encoding to compress each of the transport channels 17 until each of the transport channels 17 reaches the number of bits set forth in the bitrate allocation schedule 19. The psychoacoustic audio encoding device 406 may then specify the compressed version of each of the transport channels 19 in bitstream 21. As such, the psychoacoustic audio encoding device 406 may generate the bitstream 21 that specifies each of the transport channels 17 using the allocated number of bits.

The psychoacoustic audio encoding device 406 may specify, in the bitstream 21, the bitrate allocation per transport channel (which may also be referred to as the bitrate allocation schedule 19), which the audio decoding device 24 may parse from the bitstream 21. The audio decoding device 24 may then parse the transport channels 17 from the bitstream 21 based on the parsed bitrate allocation schedule 19, and thereby decode the HOA audio data set forth in each of the transport channels 17.

The audio decoding device 24 may, after parsing the compressed version of the transport channels 17, decode each of the compressed version of the transport channels 17 in two different ways. First, the audio decoding device 24 may perform psychoacoustic audio decoding with respect to each of the transport channels 17 to decompress the compressed version of the transport channels 17 and generate a spatially compressed version of the HOA audio data 15. Next, the audio decoding device 24 may perform spatial decompression with respect to the spatially compressed version of the HOA audio data 15 to generate (or, in other words, reconstruct) the HOA audio data 11'. The prime notation of the HOA audio data 11' denotes that the HOA audio data 11' may vary to some extent form the originally-captured HOA audio data 11 due to lossy compression, such as quantization, prediction, etc.

More information concerning decompression as performed by the audio decoding device 24 may be found in U.S. Pat. No. 9,489,955, entitled "Indicating Frame Parameter Reusability for Coding Vectors," issued Nov. 8, 2016, and having an effective filing date of Jan. 30, 2014. Additional information concerning decompression as performed by the audio decoding device 24 may also be found in U.S. Pat. No. 9,502,044, entitled "Compression of Decomposed Representations of a Sound Field," issued Nov. 22, 2016, and having an effective filing date of May 29, 2013. Furthermore, the audio decoding device 24 may be generally configured to operate as set forth in the above noted 3D Audio standard.

Figure 3A:
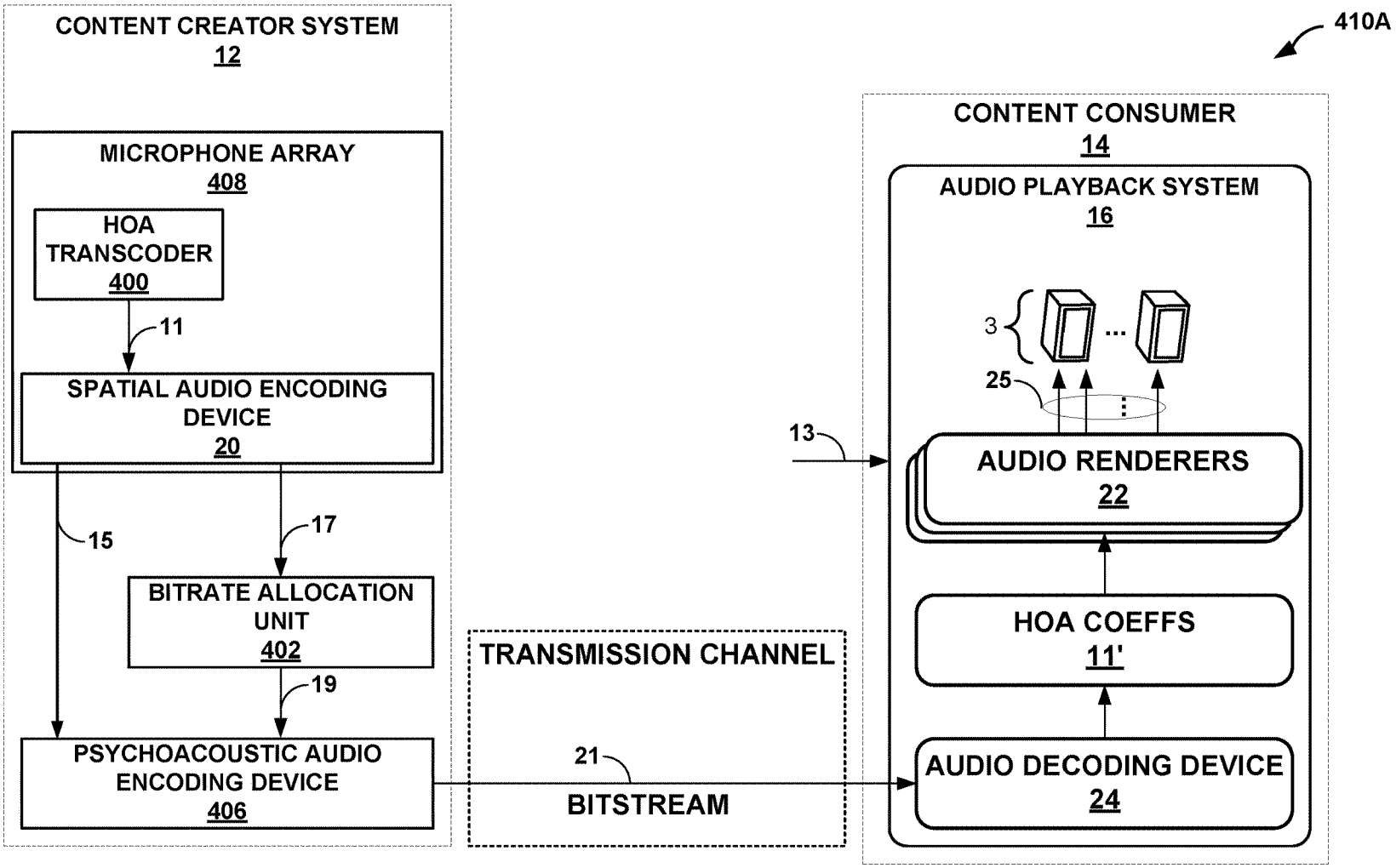
FIGS. 3A-3D are diagrams illustrating different examples of the system shown in the example of FIG. 2.

FIGS. 3A-3D are block diagrams illustrating different examples of a system that may be configured to perform various aspects of the techniques described in this disclosure. The system 410A shown in FIG. 3A is similar to the system 10 of FIG. 2, except that the microphone array 5 of the system 10 is replaced with a microphone array 408. The microphone array 408 shown in the example of FIG. 3A includes the HOA transcoder 400 and the spatial audio encoding device 20. As such, the microphone array 408 generates the spatially compressed HOA audio data 15, which is then compressed using the bitrate allocation in accordance with various aspects of the techniques set forth in this disclosure.

Figure 3B:
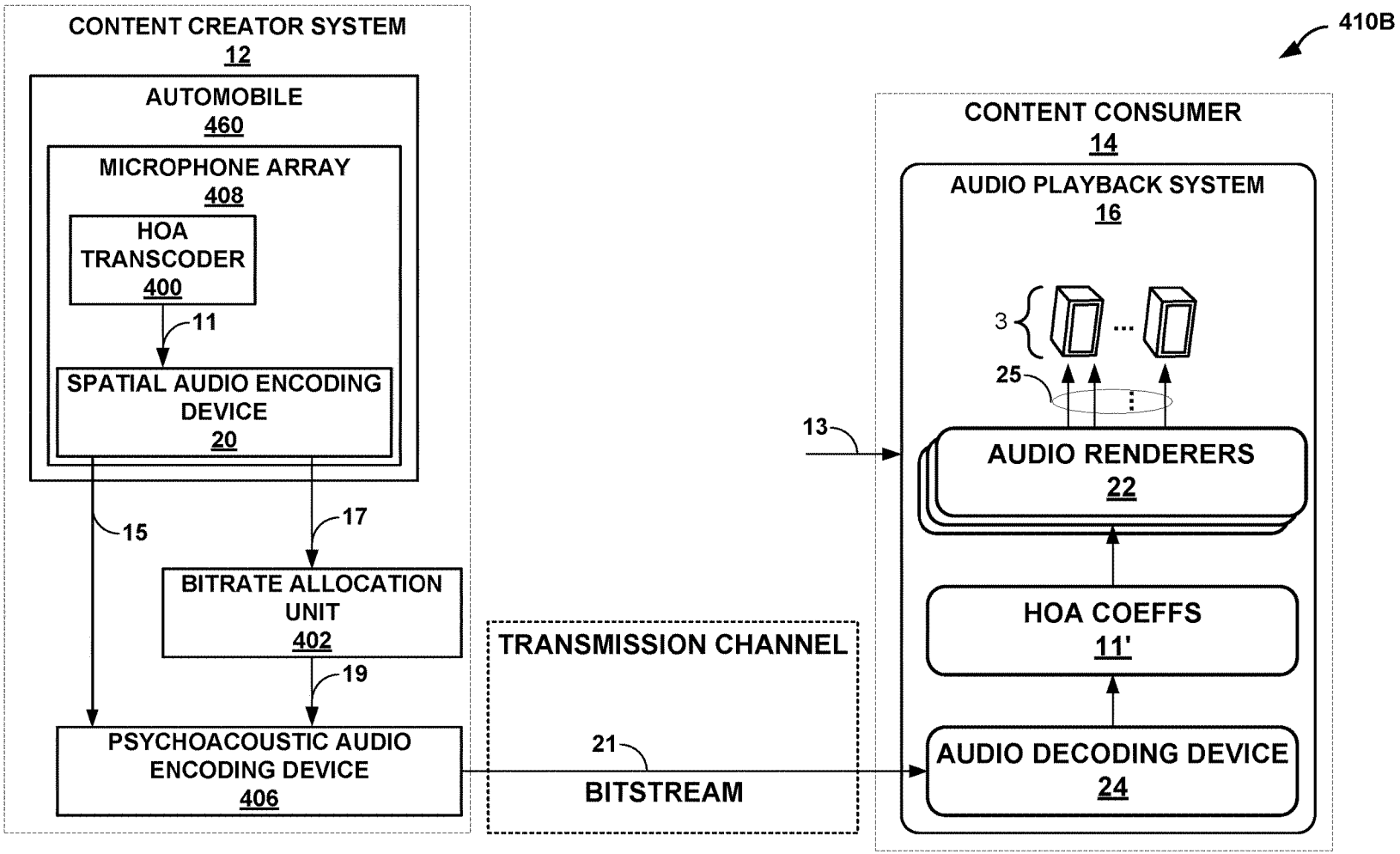

The system 410B shown in FIG. 3B is similar to the system 410A shown in FIG. 3A except that an automobile 460 includes the microphone array 408. As such, the techniques set forth in this disclosure may be performed in the context of automobiles.

Figure 3C:
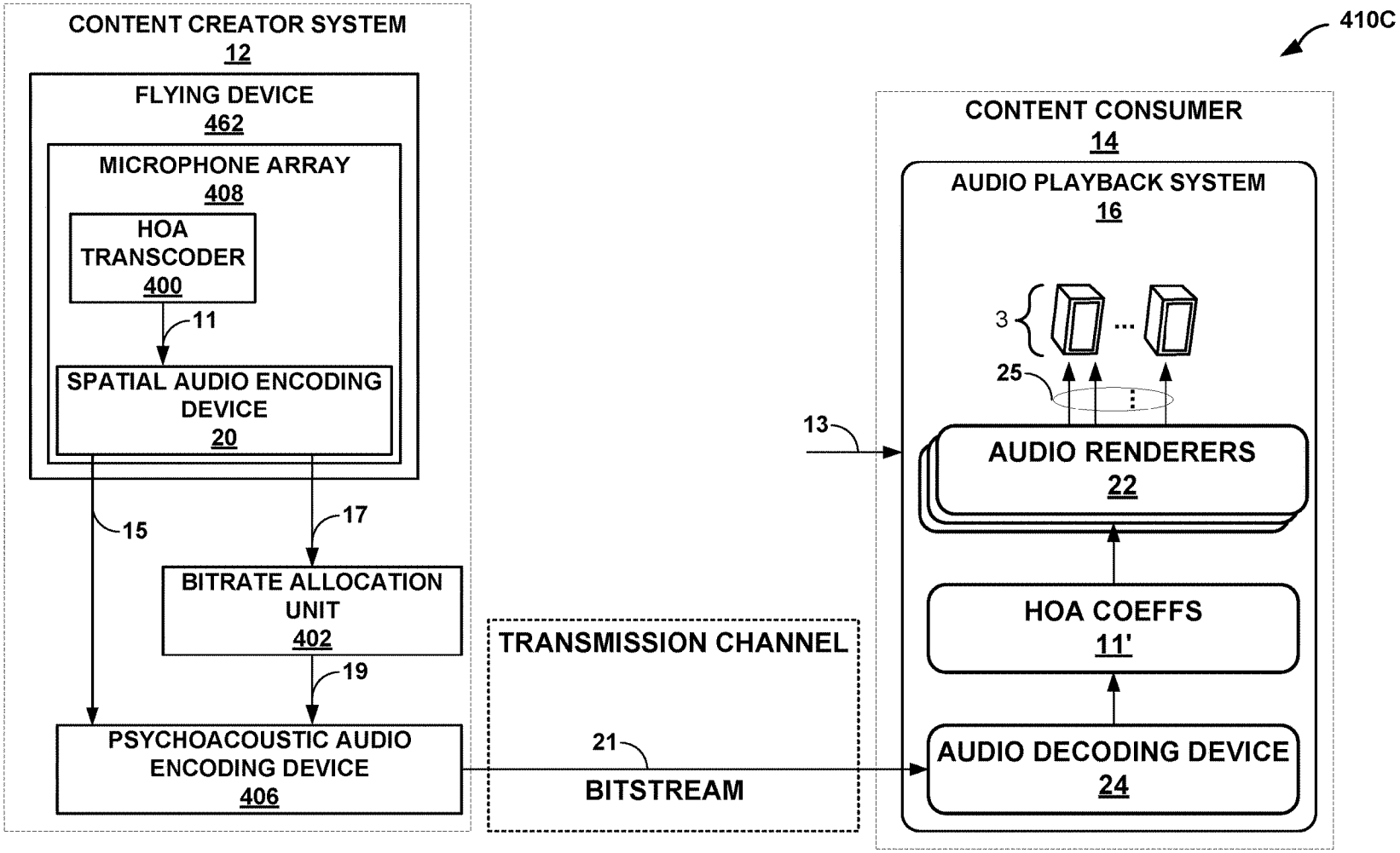

The system 410C shown in FIG. 3C is similar to the system 410A shown in FIG. 3A except that a remotely-piloted and/or autonomous controlled flying device 462 includes the microphone array 408. The flying device 462 may for example represent a quadcopter, a helicopter, or any other type of drone. As such, the techniques set forth in this disclosure may be performed in the context of drones.

Figure 3D:
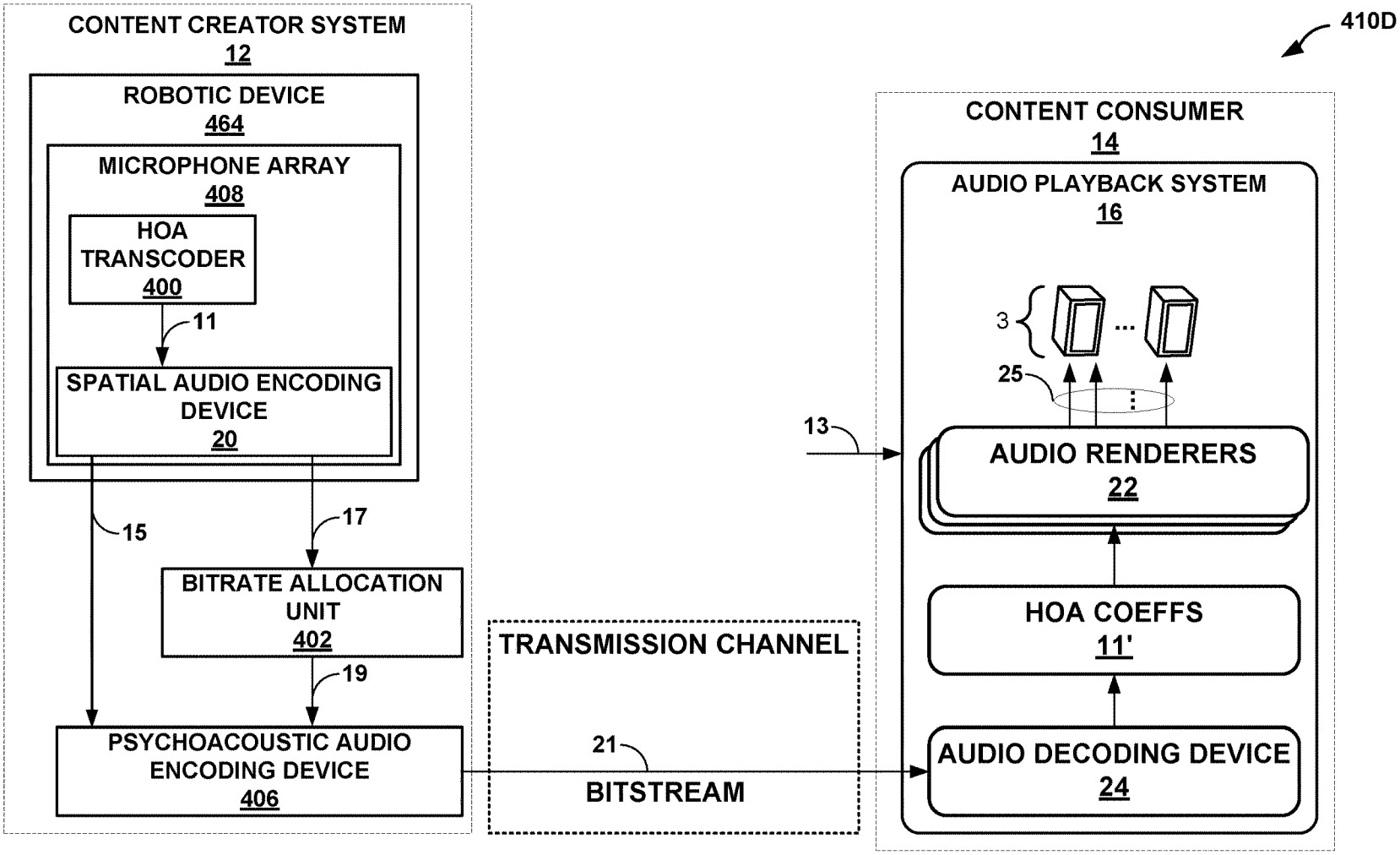

The system 410D shown in FIG. 3D is similar to the system 410A shown in FIG. 3A except that a robotic device 464 includes the microphone array 408. The robotic device 464 may for example represent a device that operates using artificial intelligence, or other types of robots. In some examples, the robotic device 464 may represent a flying device, such as a drone. In other examples, the robotic device 464 may represent other types of devices, including those that do not necessarily fly. As such, the techniques set forth in this disclosure may be performed in the context of robots.

Figure 4:
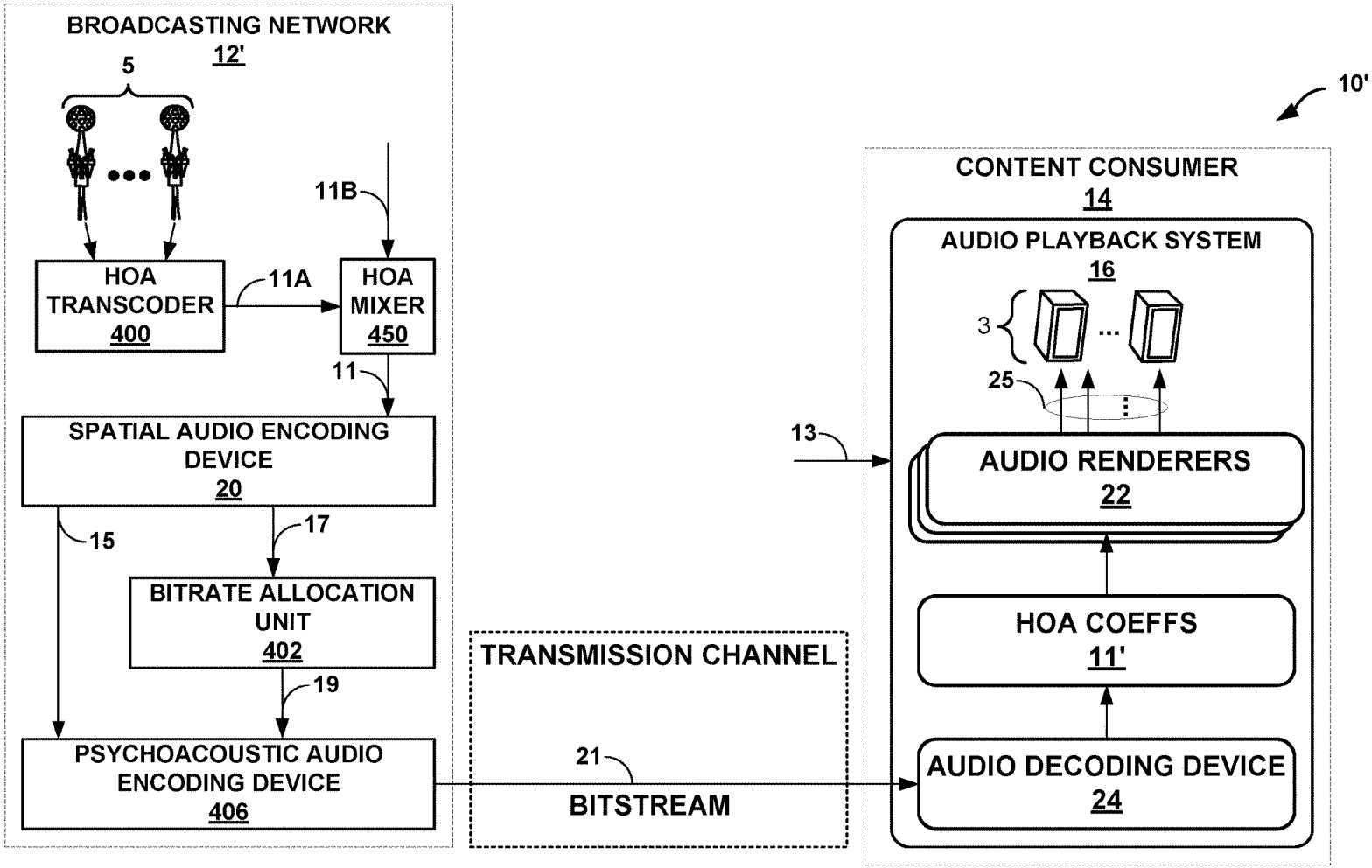
FIG. 4 is a block diagram illustrating another example of the system shown in the example of FIG. 2.

FIG. 4 is a block diagram illustrating another example of a system that may be configured to perform various aspects of the techniques described in this disclosure. The system shown in FIG. 4 is similar to the system 10 of FIG. 2 except that the content creation network 12 is a broadcasting network 12', which also includes an additional HOA mixer 450. As such, the system shown in FIG. 4 is denoted as system 10' and the broadcast network of FIG. 4 is denoted as broadcast network 12'. The HOA transcoder 400 may output the live feed HOA coefficients as HOA coefficients 11A to the HOA mixer 450. The HOA mixer represents a device or unit configured to mix HOA audio data. HOA mixer 450 may receive other HOA audio data 11B (which may be representative of any other type of audio data, including audio data captured with spot microphones or non-3D microphones and converted to the spherical harmonic domain, special effects specified in the HOA domain, etc.) and mix this HOA audio data 11B with HOA audio data 11A to obtain HOA coefficients 11.

In some contexts, such as broadcasting contexts, the audio encoding device may be split into a spatial audio encoder, which performs a form of intermediate compression with respect to the HOA representation that includes gain control, and a psychoacoustic audio encoder 406 (which may also be referred to as a "perceptual audio encoder 406") that performs perceptual audio compression to reduce redundancies in data between the gain normalized transport channels. In these instances, the bitrate allocation unit 402 may perform inverse gain control to recover the original transport channel 17, where the psychoacoustic audio encoding device 406 may perform the energy-based bitrate allocation, directional bitrate allocation, perceptual based bitrate allocation, or some combination thereof based on bitrate schedule 19 in accordance with various aspects of the techniques described in this disclosure.

Although described in this disclosure with respect to the broadcasting context, the techniques may be performed in other contexts, including the above noted automobiles, drones, and robots, as well as, in the context of a mobile communication handset or other types of mobile phones, including smart phones (which may also be used as part of the broadcasting context).

Figure 6:
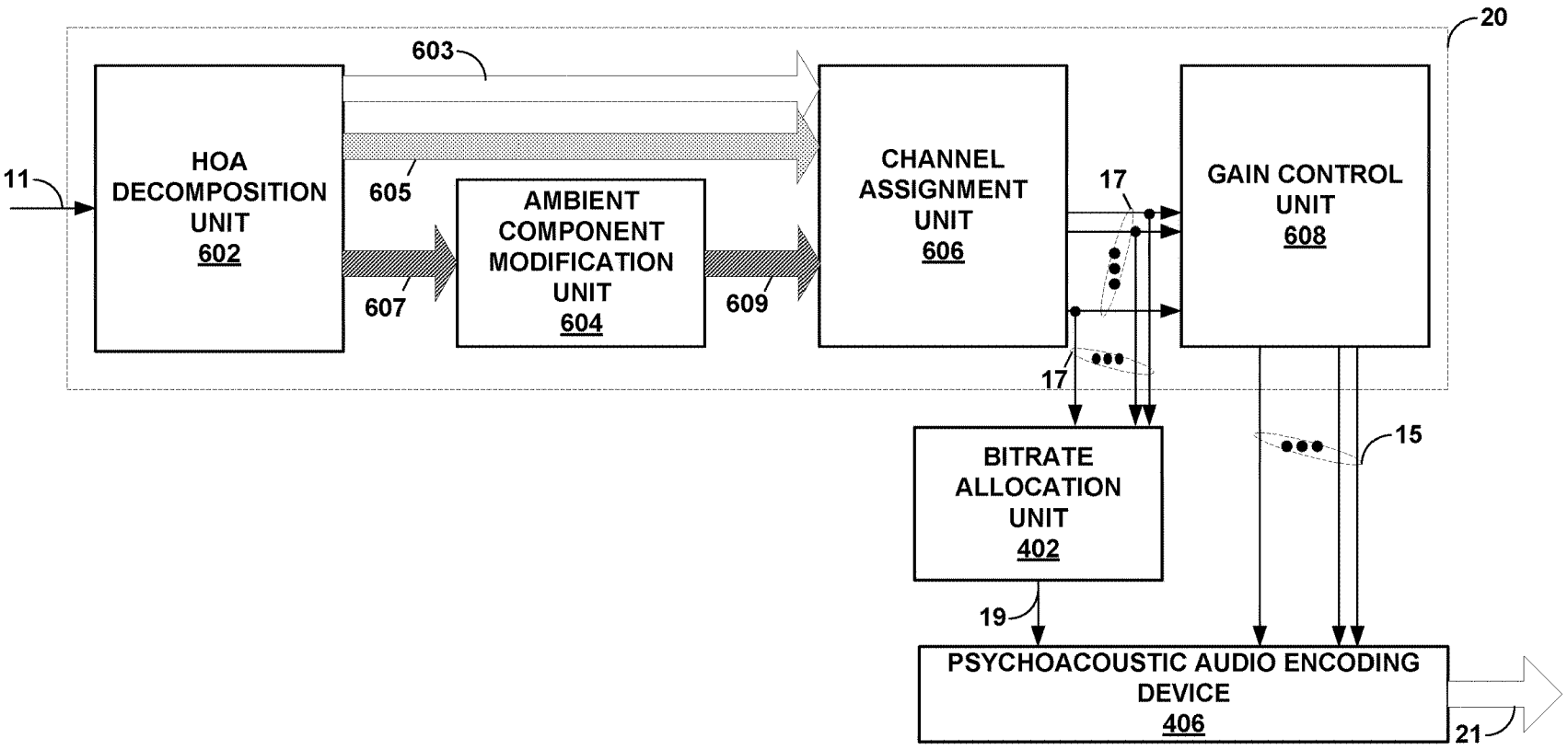
FIG. 6 is a block diagram illustrating the content creator system of FIG. 1 in more detail.

FIG. 6 is a block diagram illustrating the content creator system 12 of FIG. 1 in more detail. In the example of FIG. 6, the spatial audio encoding device 20 includes HOA decomposition unit 602, ambient component modification unit 604, channel assignment unit 606, and gain control unit 608.

The HOA decomposition unit 602 may represent a unit configured to perform a decomposition with respect to the HOA audio data 11. The decomposition may, as one example, include a linear invertible decomposition, such as a singular value decomposition (SVD), eigen value decomposition (EVD), Karhunen-Loeve transform (KLT), a rotation, a translation, or any other form of linear invertible decomposition.

The decomposition may not transform the HOA audio data 11 from the spherical harmonic domain into a different domain. Stated differently, the decomposition may result in components of the HOA audio data 11 that are defined in the same domain as the HOA audio data 11, i.e., the spherical harmonic domain. In this respect, the decomposition may differ from other decompositions that result in components defined in different domains, e.g., a Fourier transform that converts signals from a time domain into the frequency domain. As such, the decomposition may be considered domain invariant.

The HOA decomposition unit 602 may receive or otherwise obtain the HOA audio data 11, and apply the decomposition with respect to the HOA audio data 11 to decompose the HOA audio data 11 into one or more principal audio signals, spatial information corresponding to the principal audio signals, and one or more ambient HOA coefficients. The principal audio signal may be descriptive of foreground or salient components of the soundfield represented by the HOA audio data 11. The spatial information (which may be referred to as the "V-vector" having a loose reference to when the spatial information was derived using SVD) may represent a direction, a shape, and a width of the corresponding predominant audio signal. The ambient HOA coefficients may comprise a subset of the HOA coefficients specified by the HOA audio data 11 that are descriptive of ambient components of the soundfield represented by the HOA audio data 11. The HOA decomposition unit 602 may output the predominant audio signals 603 and spatial the information 605 to the channel assignment unit 606, and the ambient HOA coefficients 607 to the ambient component modification unit 604.

The ambient component modification unit 604 may represent a unit configured to modify the ambient HOA coefficients 607. Modification of the ambient HOA coefficients 607 may include energy compensation to account for energy lost from unselected ambient HOA coefficients. That is, only a subset of the HOA coefficients are selected to describe the ambient components, where some of the HOA coefficients may contain information relevant in describing the ambient components but are not selected due to bandwidth or other constraints. To account the loss of energy (which translates to gain) from the unselected ambient HOA coefficients, the ambient component modification unit 604 may perform energy compensation to increase the energy of the selected ambient HOA coefficients 607 to offset the loss of energy form the unselected ambient HOA coefficients 607. The ambient component modification unit 604 may output modified ambient HOA coefficients 609 to the channel assignment unit 606.

The channel assignment unit 606 may represent a unit configured to assign each of the predominant audio signals 603 and the modified ambient HOA coefficients 609 to a respective one of the transport channels 17. The number of the transport channels 17 may depend on a number of factors, such as available bandwidth, target bitrate, etc. The channel assignment unit 606 may specify the spatial components 605 as separate sideband information (which may be considered a separate optional transport channel). The channel assignment unit 606 may output the transport channels 17 to gain control unit 608 and separately to the bitrate allocation unit 402 (which represent transport channels sent prior to application to gain control).

The gain control unit 608 may represent a unit configured to perform gain control (which may also be referred to as "adaptive gain control" or "AGC") with respect to the transport channels 17. Again, as noted above, FIG. 5 is a diagram illustrating the effects of gain control as applied to the transport channels 17 so as to normalize the gain across the transport channels 17. Normalization of the gain may reduce the dynamic range and thereby permit more efficient psychoacoustic audio encoding (or, in other words, psychoacoustic audio compression) in terms of allowing for more compact compression.

The bitrate allocation unit 402 may operate as described above to perform the bitrate allocation with respect to the transport channels 17 prior to application of gain control by the gain control unit 608. Various aspects of the different forms of analysis performed by the bitrate allocation unit 402 are described below with respect to FIGS. 7A-11B. The bitrate allocation unit 402 may output the bitrate allocation schedule 19 to psychoacoustic audio encoding device 406, which may perform psychoacoustic audio encoding with respect to the intermediately formatted HOA audio data 15 based on the bitrate allocation schedule 19 to generate the bitstream 21.

Figure 7A:
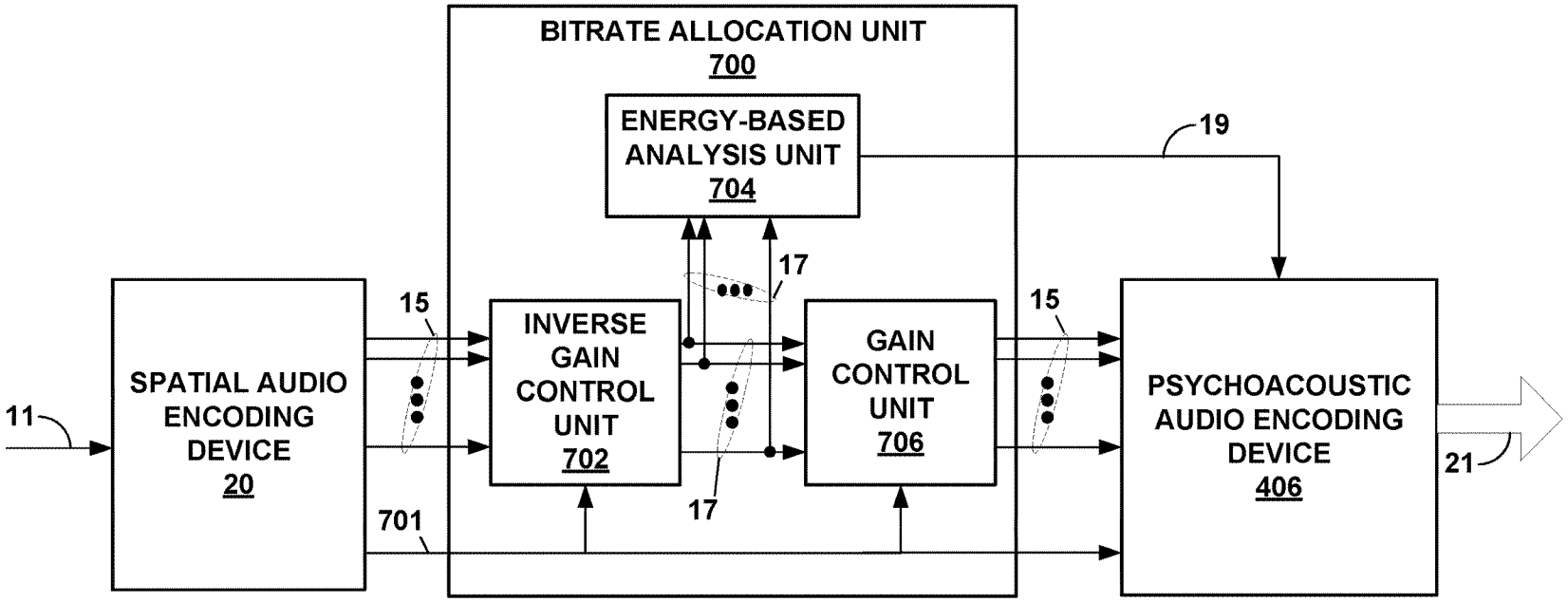
FIGS. 7A-10B are block diagrams illustrating eight different examples of the bitrate allocation unit shown in FIGS. 2-6 in performing various aspects of the bitrate allocation techniques described in this disclosure.
Figure 7B:
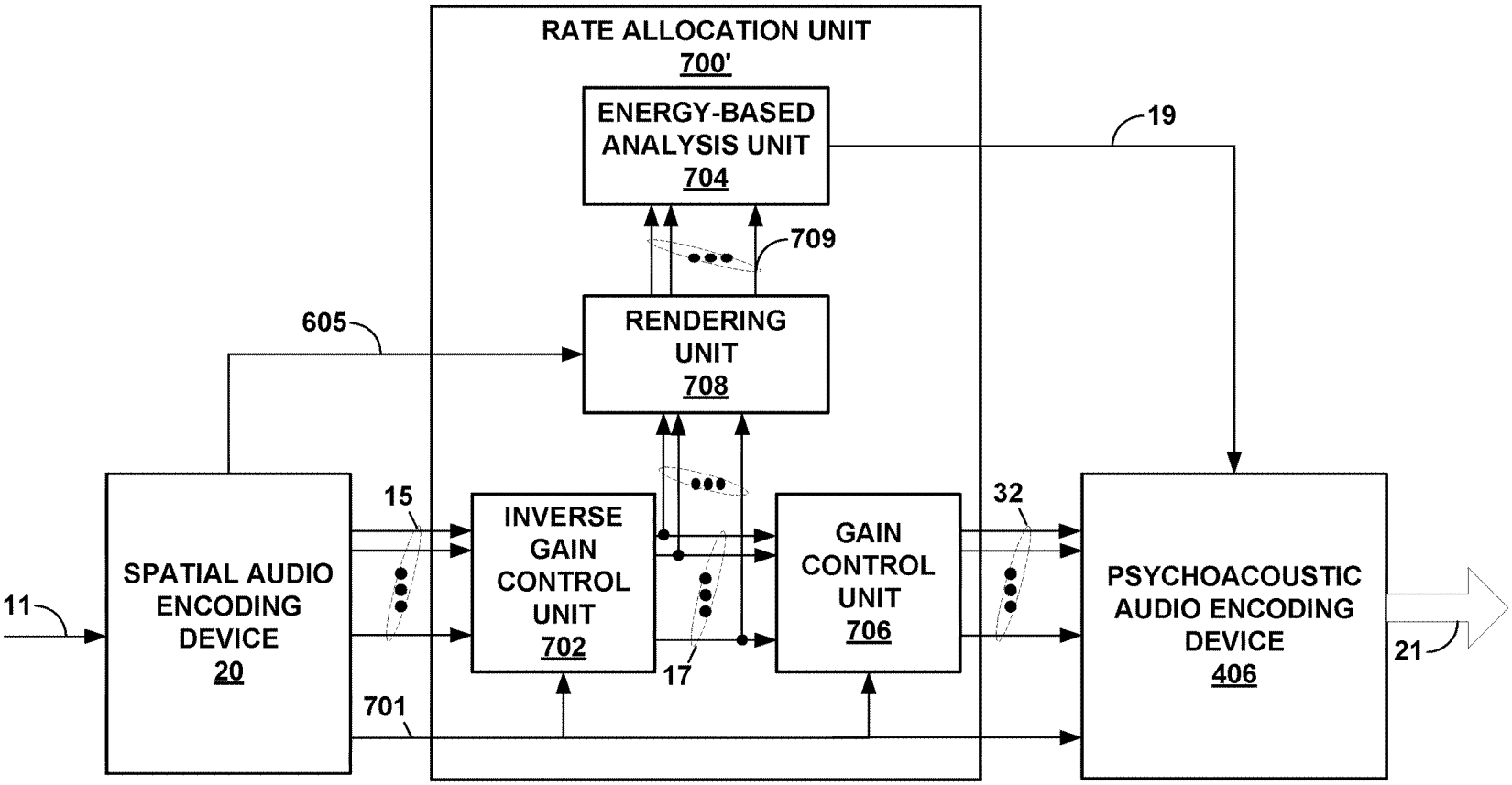

FIGS. 7A and 7B are block diagrams illustrating two different examples of the bitrate allocation unit shown in FIGS. 2-6 in performing various aspects of the bitrate allocation techniques described in this disclosure. As noted above, in certain contexts, such as the broadcast context, the spatial audio encoding device 20 may be separate from the psychoacoustic audio encoding device 406. As such, the spatial audio encoding device 20 may have to perform gain control to efficiently transmit the intermediately formatted audio data 15 through the broadcast network (e.g., via satellite uplinks and downlinks, for processing by legacy broadcast equipment, mixers, etc.).

The bitrate allocation unit 700 shown in FIG. 7A may represent one example the bitrate allocation unit 402 described above. In the example of FIG. 7A, the bitrate allocation unit 700 includes an inverse gain control unit 702, an energy-based analysis unit 704, and a gain control unit 706. The inverse gain control unit 702 may represent a unit configured to perform inverse gain control with respect to the intermediately formatted HOA audio data 15 (which may also be referred to as "mezzanine formatted HOA audio data 15") to transition the transport channels 17 from the plot 402B of FIG. 5 to resemble the transport channels 17 shown on the left plot 402A. The inverse gain control unit 702 may perform the inverse gain control unit based on gain control information 701 specified in the sideband information of the intermediately formatted HOA audio data 15. The gain control information 701 may include a respective gain correction exponent associated with each of the transport channels 17 and a respective gain correction exception flag associated with each of the transport channels. After performing inverse gain control, the inverse gain control unit 702 may output the transport channels 17 to both the energy-based analysis unit 704 and the gain control unit 706.

The energy-based analysis unit 704 represents a unit configured to perform an energy based analysis with respect to the transport channels 17 in order to determine the bitrate allocation schedule 19. The energy-based analysis unit 704 may determine the bitrate allocation schedule 19 based on the energy levels of each of the transport channels 17. In some examples, the energy-based analysis unit 704 may determine the bitrate allocation schedule 19 based on the energy levels of each of the transport channels 17 above a masking threshold.

Each frame of the intermediately formatted HOA audio data 15 may be assigned a total number of bits available for each frame. The energy-based analysis unit 704 may perform the energy-based analysis with respect to each of the transport channels 17 and determine a total energy of the respective audio component (which may refer to the predominant audio signals or the ambient HOA coefficients shown in FIG. 6) specified in each of the transport channels 17. The energy-based analysis unit 704 may assign more bits to the audio components with a higher energy relative to the remaining ones of the audio components.

The energy-based analysis unit 704 may assign the number of bits to each of the transport channels according to the relative energy of the transport channel relative to the remaining transport channels 17. For example, a transport channel may have ⅓ of the overall energy of all the transport channels. As such, the energy-based analysis unit 704 may assign ⅓ of the total number of bits for the audio frame to the corresponding transport channel. The energy-based analysis unit 704 may, in this way, determine the bitrate allocation schedule 19, which is provided to the psychoacoustic audio encoding device 406.

The gain control unit 706 may represent a unit configured to perform gain control with respect to the transport channels according to the gain control information 701. The gain control unit 706 may perform the gain control to generate the intermediately formatted HOA audio data 15. The bitrate allocation unit 402 may output the intermediately formatted HOA audio data 15 along with the gain control information 701 (and any other sideband information) to the psychoacoustic audio encoding device 406, which operates as described above to generate the bitstream 21.

In the example of FIG. 7B, the bitrate allocation unit 700' is denoted with a prime notation to indicate that the bitrate allocation unit 700' is slightly different than the bitrate allocation unit 700 shown in FIG. 7A in that the bitrate allocation unit 700' includes an additional unit, i.e., rendering unit 708 in this example. The rendering unit 708 may represent a unit configured to render the audio components of transport channels 17 from the spherical harmonic domain to the spatial domain, thereby generating one or more speaker feeds mapped to spatial locations within the soundfield.

The rendering unit 708 may render the speaker feeds based on the audio components of the transport channels 17 (e.g., the predominant audio signals and/or the ambient HOA coefficients) and the spatial components 605 corresponding to the predominant audio signals (when specified in the transport channels 17). The rendering unit 708 may, in other words, render the transport channels 17 from the spherical harmonic domain to spatial domain channels 709. The rendering unit 708 may, in some instances, render the transport channels 17 from the spherical harmonic domain to uniformly distributed spatial domain channels 709. The uniformly distributed spatial domain channels 709 may refer to spatial domain channels set out on the listening half sphere in a uniform manner. The rendering unit 708 may output the spatial domain channels 709 to the energy-based analysis unit 704, which may operate similar to that described above to determine bitrate allocation schedule 19.

Figure 8A:
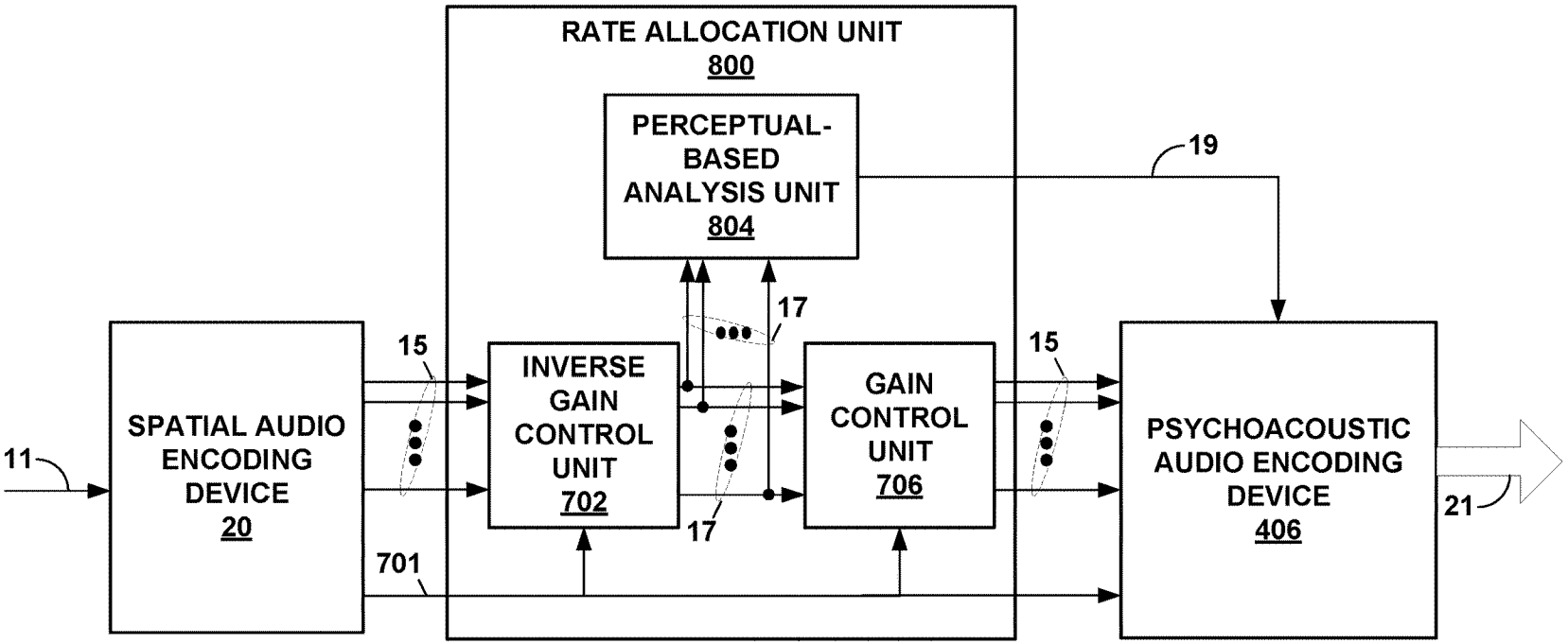
Figure 8B:
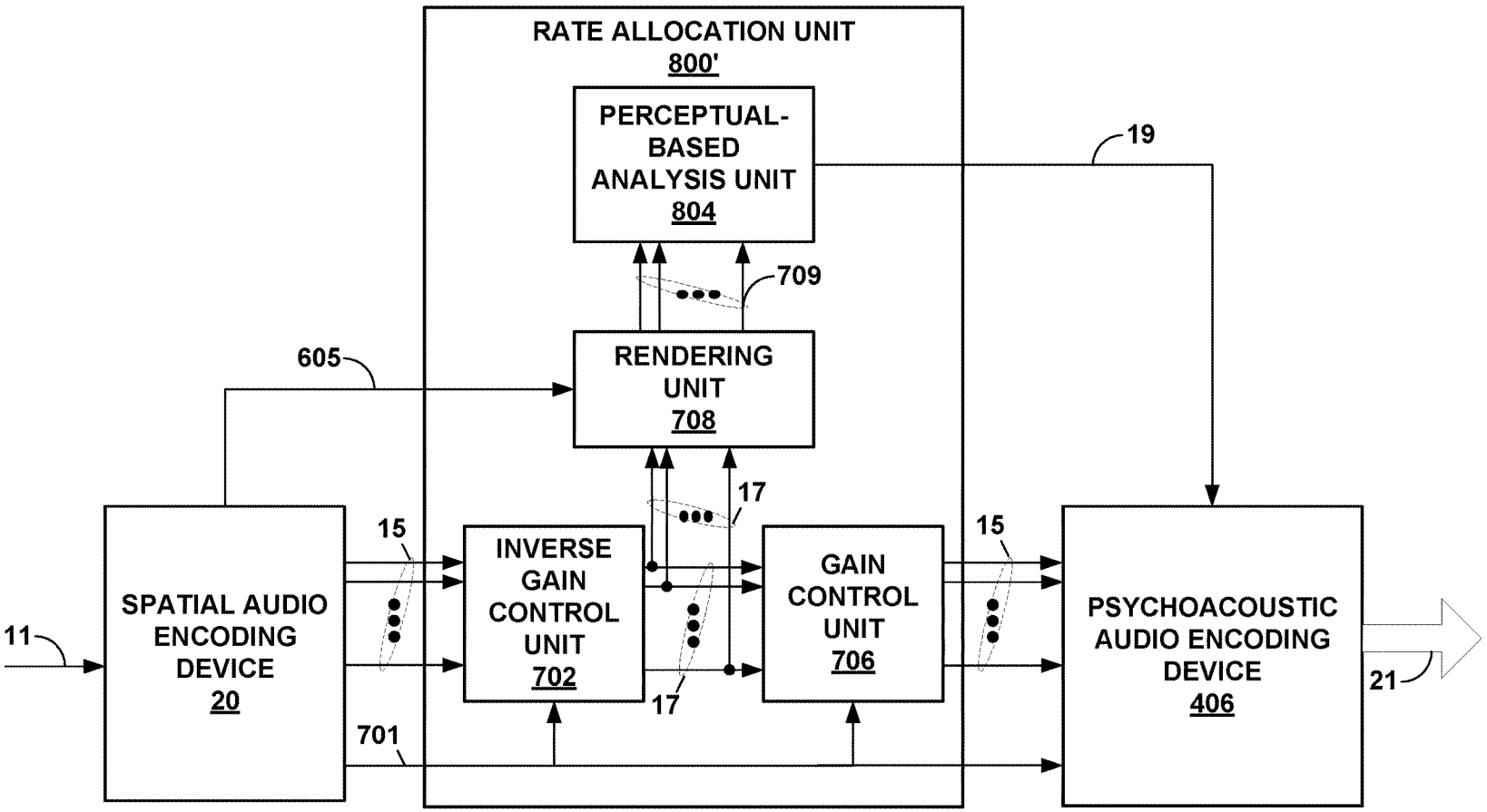

FIGS. 8A and 8B are block diagrams illustrating two different examples of the bitrate allocation unit shown in FIGS. 2-6 in performing various aspects of the bitrate allocation techniques described in this disclosure. The bitrate allocation unit 800 shown in FIG. 8A may represent one example the bitrate allocation unit 402 described above. Moreover, the bitrate allocation unit 800 may be similar to the bitrate allocation unit 700 shown in FIG. 7A except that the bitrate allocation unit 800 includes a perceptual-based analysis unit 804 in place of the energy-based analysis unit 704.

The perceptual-based analysis unit 804 represents a unit configured to perform a perceptual-based analysis with respect to the transport channels 17 in order to determine the bitrate allocation schedule 19. The perceptual-based analysis unit 804 may determine the bitrate allocation schedule 19 based on principles of auditory masking. Auditory masking may refer to spatial masking and/or simultaneous masking.

Spatial masking may leverage tendencies of the human auditory system to mask neighboring spatial portions (or 3D segments) of the sound field when a high energy acoustic energy is present in the sound field. That is, high energy portions of the sound field may overwhelm the human auditory system such that portions of energy (often, adjacent areas of low energy) are unable to be detected (or discerned) by the human auditory system. As a result, the audio encoding unit 18 may allow lower number of bits (or equivalently higher quantization noise) to represent the sound field in these so-called "masked" segments of space, where the human auditory systems may be unable to detect (or discern) sounds when high energy portions are detected in neighboring areas of the sound field defined by the SHC 20A. This is similar to representing the sound field in those "masked" spatial regions with lower precision (meaning possibly higher noise).

Simultaneous masking, much like spatial masking, involves the phenomena of the human auditory system, where sounds produced concurrent (and often at least partially simultaneously) to other sounds mask the other sounds. Typically, the masking sound is produced at a higher volume than the other sounds. The masking sound may also be similar to close in frequency to the masked sound.

In some examples, the perceptual-based analysis unit 804 may determine the bitrate allocation schedule 19 based on the auditory masking analysis in which it is determined which aspects of the soundfield are salient in view of other aspects of the soundfield. When one of the transport channels 17 includes a component that is not audible in view of components specified by other transport channels 17, the perceptual-based analysis unit 804 may assign less bits to the one of the transport channels 17 including the masked component relative to the other one of the transport channels 17.

The perceptual-based analysis unit 804 may, in other words, assign a number of bits to each of the transport channels according to the perception of the transport channel relative to the remaining transport channels 17. The perceptual-based analysis unit 804 may, in this way, determine the bitrate allocation schedule 19, which is provided to the psychoacoustic audio encoding device 406.

In the example of FIG. 8B, the bitrate allocation unit 800' is denoted with a prime notation to indicate that the bitrate allocation unit 800' is slightly different than the bitrate allocation unit 800 shown in FIG. 8A in that the bitrate allocation unit 800' includes an additional unit, i.e., rendering unit 708 in this example. The rendering unit 708 may represent a unit configured to render the audio components of transport channels 17 from the spherical harmonic domain to the spatial domain, thereby generating one or more speaker feeds mapped to spatial locations within the soundfield.

The rendering unit 708 may render the speaker feeds based on the audio components of the transport channels 17 (e.g., the predominant audio signals and/or the ambient HOA coefficients) and the spatial components 605 corresponding to the predominant audio signals (when specified in the transport channels 17). The rendering unit 708 may, in other words, render the transport channels 17 from the spherical harmonic domain to spatial domain channels 709. The rendering unit 708 may, in some instances, render the transport channels 17 from the spherical harmonic domain to uniformly distributed spatial domain channels 709. The uniformly distributed spatial domain channels 709 may refer to spatial domain channels set out on the listening half sphere in a uniform manner. The rendering unit 708 may output the spatial domain channels 709 to the perceptual-based analysis unit 804, which may operate similar to that described above to determine bitrate allocation schedule 19.

Figure 9A:
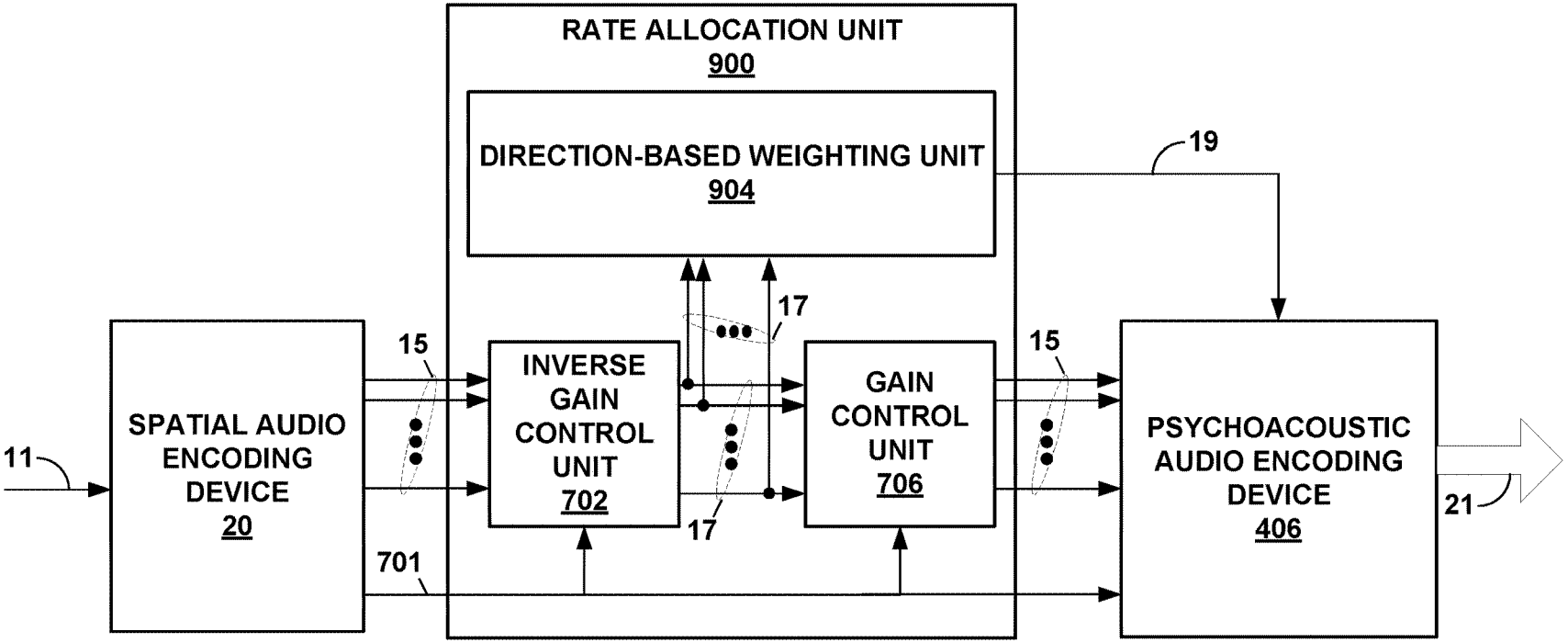
Figure 9B:
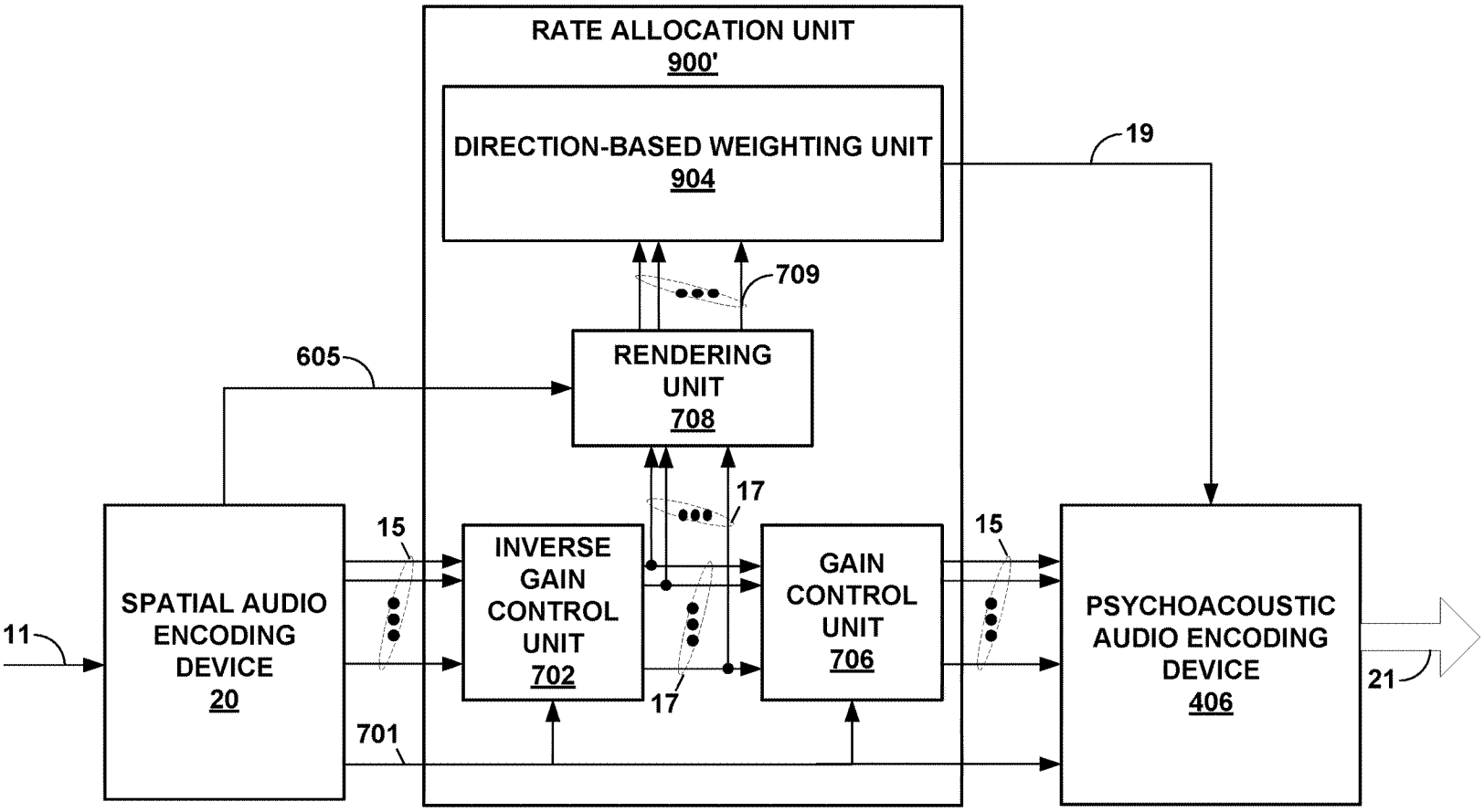

FIGS. 9A and 9B are block diagrams illustrating two different examples of the bitrate allocation unit shown in FIGS. 2-6 in performing various aspects of the bitrate allocation techniques described in this disclosure. The bitrate allocation unit 900 shown in FIG. 9A may represent one example the bitrate allocation unit 402 described above. Moreover, the bitrate allocation unit 900 may be similar to the bitrate allocation unit 700 shown in FIG. 7A except that the bitrate allocation unit 800 includes a direction-based weighting unit 904 in place of the energy-based analysis unit 704.

The direction-based weighting unit 904 represents a unit configured to perform a direction-based analysis with respect to the transport channels 17 in order to determine the bitrate allocation schedule 19. In some examples, the direction-based weighting unit 904 may determine the bitrate allocation schedule 19 based on a direction-based weighting associated with each of the transport channels 17. The direction-based weighting unit 904 may, in other words, assign a number of bits to each of the transport channels according to the directionality of a component specified by the transport channel relative to the components of the remaining transport channels 17. The direction-based weighting unit 904 may, in this way, determine the bitrate allocation schedule 19, which is provided to the psychoacoustic audio encoding device 406.

That is, the direction-based weighting unit 904 may determine the bitrate allocation schedule 19 as follows. An i-th HOA transport channel (i=1, 2, . . . , I) is rendered to N speakers. When the energy of an n-th speaker is e_{i, n}, the direction-based weighting unit 904 may determine a total weighting for the i-th HOA transport channel by:

$$w_i=\text{sum}_\{n=1,2,\ldots,N\}D(\theta_n,\phi_n)*e_\{i,n\}$$

or $$w_i=\text{sum}_\{n=1,2,\ldots,N\}D(\theta_n,\phi_n)*\text{sqrt}(e_\{i,n\})$$

and the rate allocation for the i-th HOA transport channel is $$R_i=R*w_i/(\text{sum}_\{j=1,2,\ldots,I\}w_j)$$

where R is the total bits that can be allocated to by the psychoacoustic audio encoding device 406. The collection of R_i for each transport channels forms the bitrate allocation schedule 19.

In the example of FIG. 9B, the bitrate allocation unit 900' is denoted with a prime notation to indicate that the bitrate allocation unit 900' is slightly different than the bitrate allocation unit 900 shown in FIG. 9A in that the bitrate allocation unit 900' includes an additional unit, i.e., rendering unit 708 in this example. The rendering unit 708 may represent a unit configured to render the audio components of transport channels 17 from the spherical harmonic domain to the spatial domain, thereby generating one or more speaker feeds mapped to spatial locations within the soundfield.

The rendering unit 708 may render the speaker feeds based on the audio components of the transport channels 17 (e.g., the predominant audio signals and/or the ambient HOA coefficients) and the spatial components 605 corresponding to the predominant audio signals (when specified in the transport channels 17). The rendering unit 708 may, in other words, render the transport channels 17 from the spherical harmonic domain to spatial domain channels 709. The rendering unit 708 may, in some instances, render the transport channels 17 from the spherical harmonic domain to uniformly distributed spatial domain channels 709. The uniformly distributed spatial domain channels 709 may refer to spatial domain channels set out on the listening half sphere in a uniform manner. The rendering unit 708 may output the spatial domain channels 709 to the direction-based weighting unit 904, which may operate similar to that described above to determine bitrate allocation schedule 19.

Figure 10A:
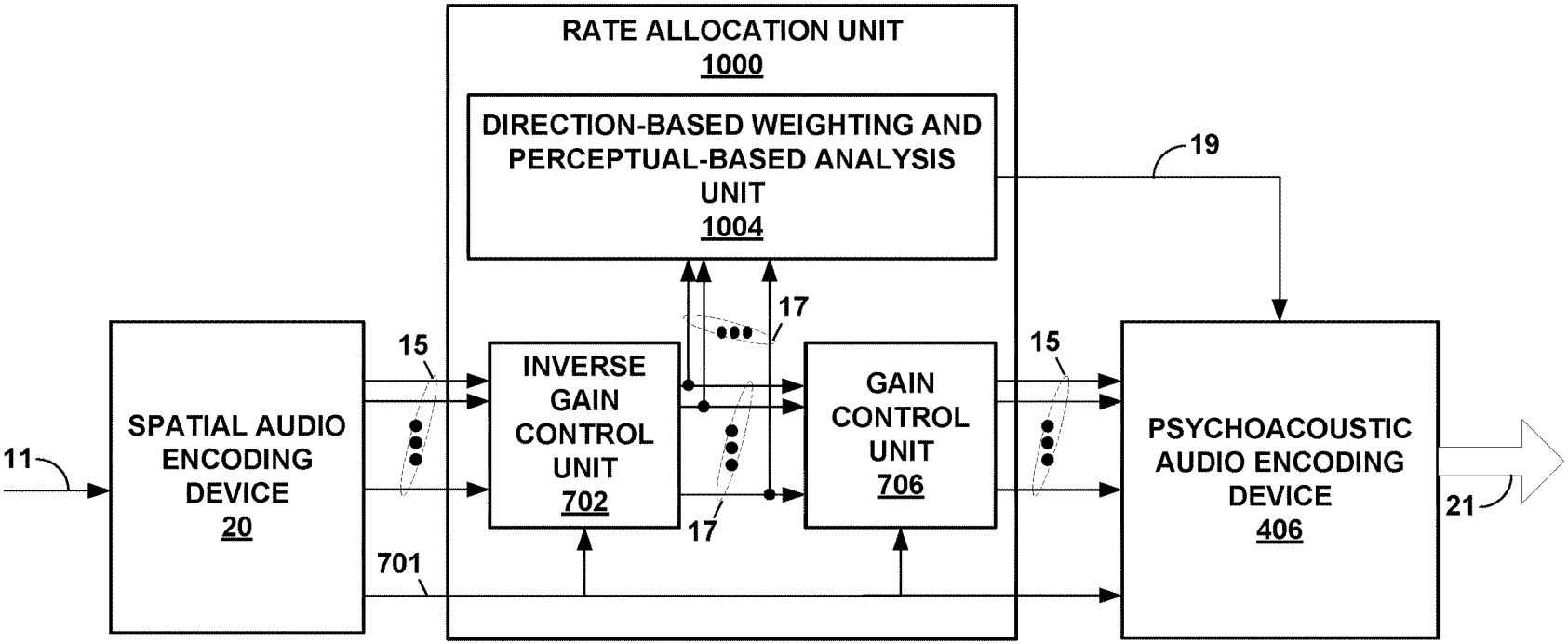
Figure 10B:
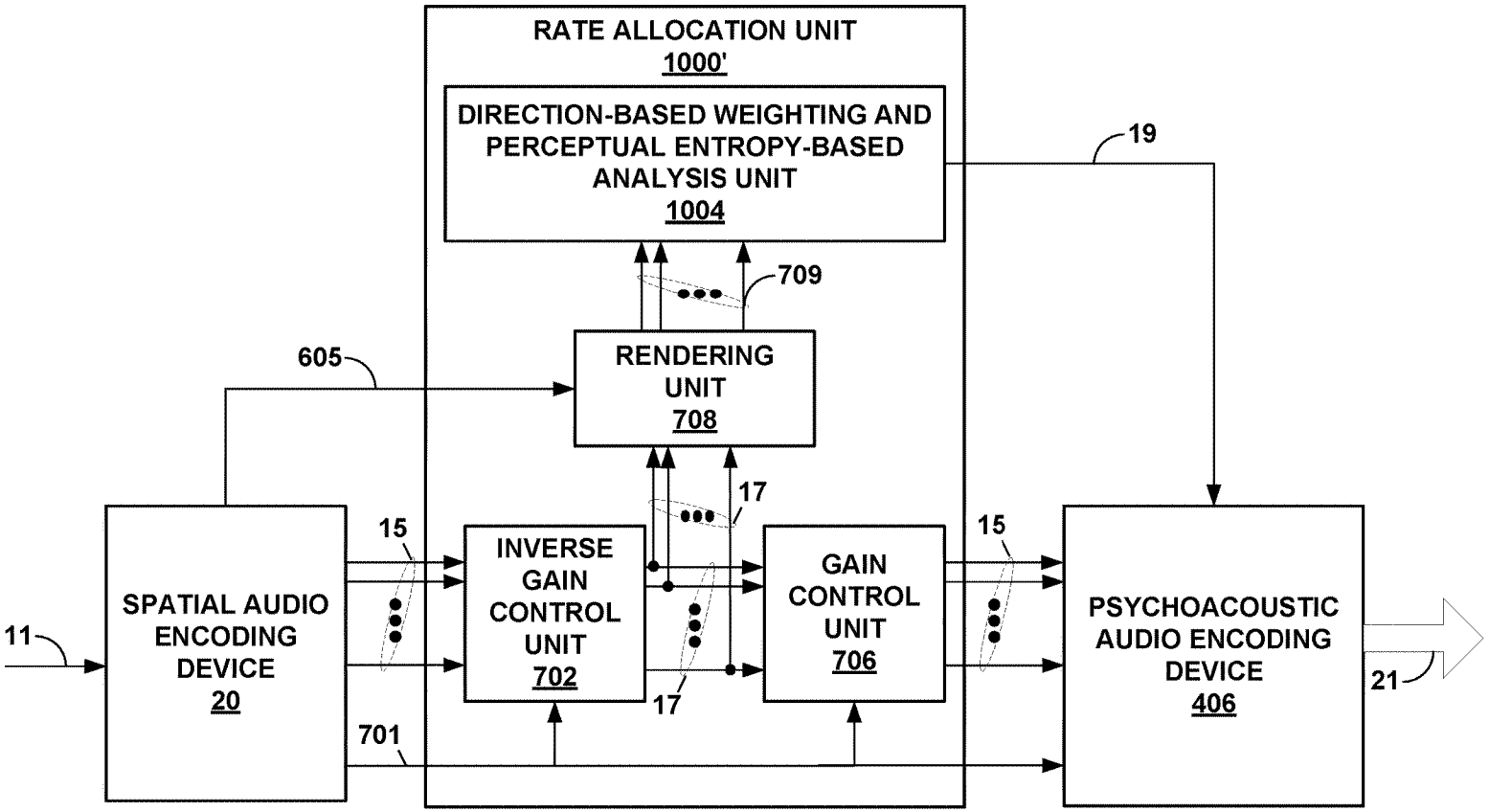

FIGS. 10A and 10B are block diagrams illustrating two different examples of the bitrate allocation unit shown in FIGS. 2-6 in performing various aspects of the bitrate allocation techniques described in this disclosure. The bitrate allocation unit 1000 shown in FIG. 10A may represent one example the bitrate allocation unit 402 described above. Moreover, the bitrate allocation unit 1000 may be similar to the bitrate allocation unit 900 shown in FIG. 9A except that the bitrate allocation unit 800 includes a direction-based weighting unit and perceptual-based analysis unit 904 in place of the direction-based weighting unit 904.

The direction-based weighting unit and perceptual-based analysis unit 1004 represents a unit configured to perform both a direction-based weighting and the above described perceptual-based analysis with respect to the transport channels 17 in order to determine the bitrate allocation schedule 19. The direction-based weighting and perceptual-based analysis unit 1004 may, in other words, assign a number of bits to each of the transport channels according to the perception of a directionally weighted component specified by the transport channel relative to the directionally weighted components of the remaining transport channels 17. The direction-based weighting and perceptual-based analysis unit 904 may, in this way, determine the bitrate allocation schedule 19, which is provided to the psychoacoustic audio encoding device 406.

In the example of FIG. 10B, the bitrate allocation unit 1000' is denoted with a prime notation to indicate that the bitrate allocation unit 1000' is slightly different than the bitrate allocation unit 1000 shown in FIG. 10A in that the bitrate allocation unit 1000' includes an additional unit, i.e., rendering unit 708 in this example. The rendering unit 708 may represent a unit configured to render the audio components of transport channels 17 from the spherical harmonic domain to the spatial domain, thereby generating one or more speaker feeds mapped to spatial locations within the soundfield.

The rendering unit 708 may render the speaker feeds based on the audio components of the transport channels 17 (e.g., the predominant audio signals and/or the ambient HOA coefficients) and the spatial components 605 corresponding to the predominant audio signals (when specified in the transport channels 17). The rendering unit 708 may, in other words, render the transport channels 17 from the spherical harmonic domain to spatial domain channels 709. The rendering unit 708 may, in some instances, render the transport channels 17 from the spherical harmonic domain to uniformly distributed spatial domain channels 709. The uniformly distributed spatial domain channels 709 may refer to spatial domain channels set out on the listening half sphere in a uniform manner. The rendering unit 708 may output the spatial domain channels 709 to the direction-based weighting and perceptual-based analysis unit 1004, which may operate similar to that described above to determine bitrate allocation schedule 19.

Figure 11:
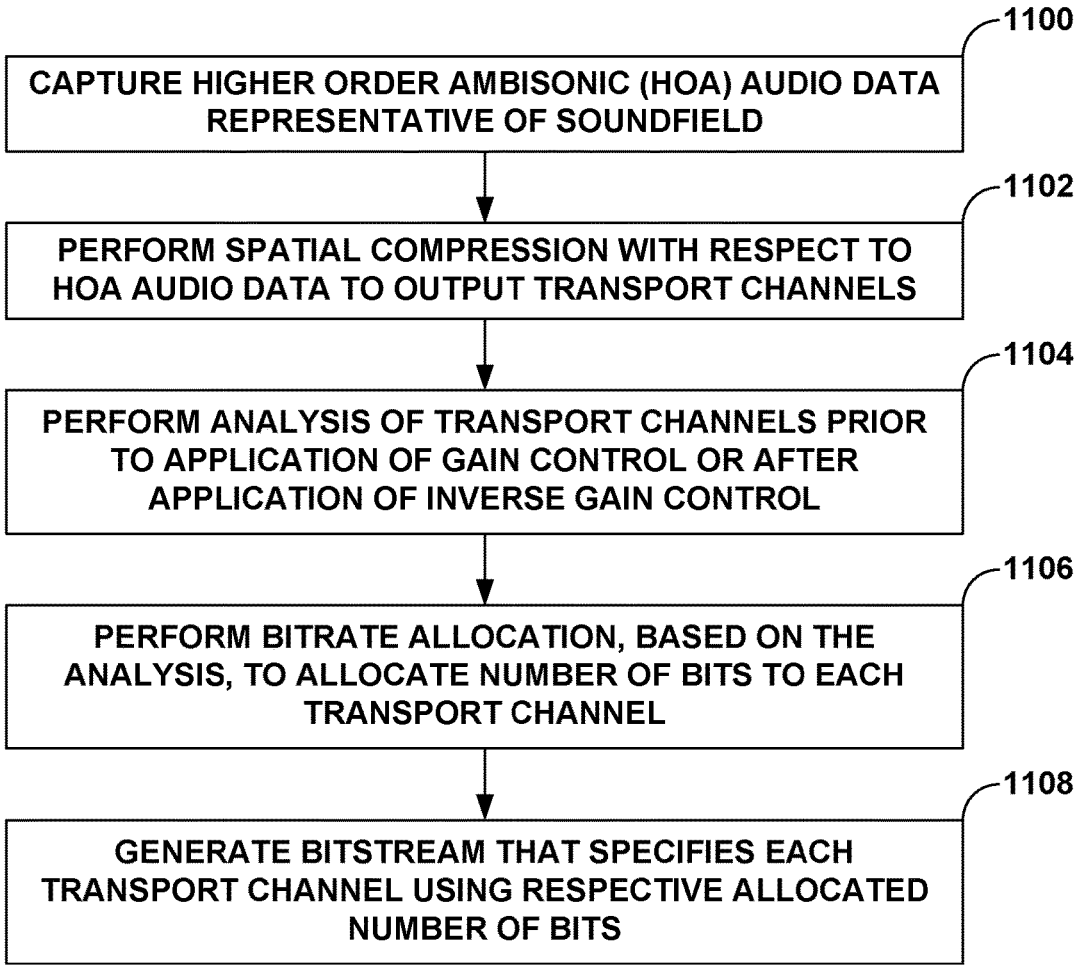
FIG. 11 is a flowchart illustrating example operation of content creator system shown in FIGS. 2-4 in performing various aspects of the bitrate allocation techniques described in this disclosure.

FIG. 11 is a flowchart illustrating example operation of content creator system shown in FIGS. 2-4 in performing various aspects of the bitrate allocation techniques described in this disclosure. In the example of FIG. 11, the microphones 5 may capture higher order ambisonic (HOA) audio data 11 representative of a soundfield (1100). The microphones 5 may output the HOA audio data 11 to the spatial audio encoding device 20, which may perform spatial compression with respect to the HOA audio data to output transport channels 17 (1102). The transport channels 17 may be representative of a spatially compressed version of HOA audio data 11.

The spatial audio encoding device 20 may output the transport channels 17 to the bitrate allocation unit 402, while also outputting intermediately formatted HOA audio data 15 to psychoacoustic audio encoding device 406. The bitrate allocation unit 402 may perform an analysis of the transport channels 17 prior to application of gain control or after application of inverse gain control to the transport channels 17 (1104). The analysis may include any combination of the foregoing analysis, e.g., the energy-based analysis, the perceptual-based analysis, and/or the direction-based weighting analysis. The bitrate allocation unit 402 may next perform bitrate allocation, based on the analysis, to allocate a number of bits to each of the transport channels 17 (1106).

The bitrate allocation unit 402 may specify the number of bits allocated to each of the transport channels 17 in the bitrate allocation schedule 19 shown in the examples of FIGS. 2-4 and 6-10B. The bitrate allocation unit 402 may provide the bitrate allocation schedule 19 to the psychoacoustic audio encoding device 406, which may generate a bitstream 21 that specifies each of the transport channels 17 using the respective allocated number of bits set forth in the bitrate allocation schedule 19 (1108).

Figure 12:
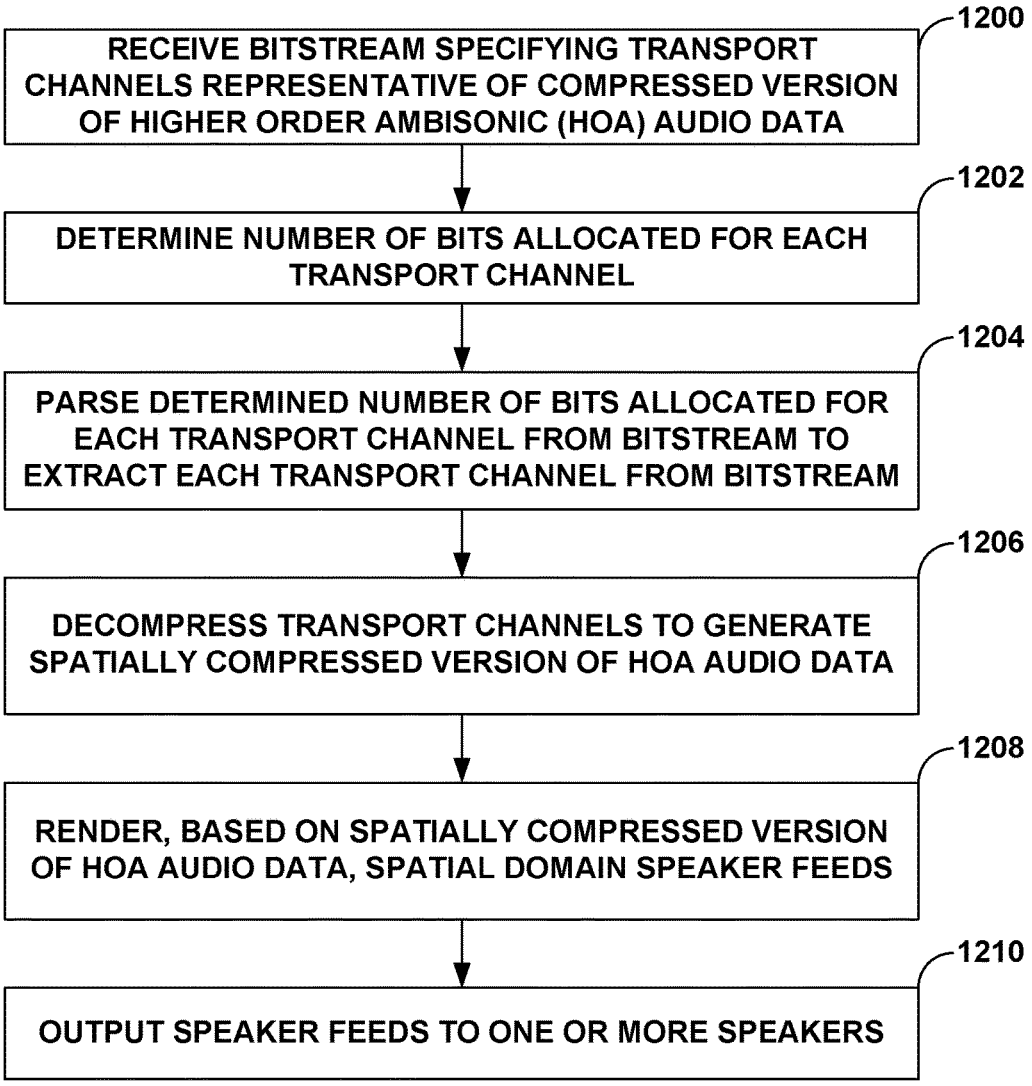
FIG. 12 is a flowchart illustrating example operation of the audio decoding device shown in the example of FIGS. 2-4 in performing various aspects of the bitrate allocation techniques described in this disclosure.

FIG. 12 is a flowchart illustrating example operation of the audio decoding device shown in the example of FIGS. 2-4 in performing various aspects of the bitrate allocation techniques described in this disclosure. Initially, the audio decoding device 24 may receive bitstream 21 specifying transport channels 17 representative of a compressed version of higher order ambisonic (HOA) audio data 11 (1200).

Next, the audio decoding device 24 may determine a number of bits allocated for each of the transport channels 17 (1202). In some examples, the audio decoding device 24 may determine the number of bits allocated for each of the transport channels 17 by parsing the bitrate allocation schedule 19 from sideband information specified by the bitstream 21. As noted above, the number of bits allocated to each of the transport channels 17 is determined prior to performing gain control with respect to each of the transport channels 17 or after performing inverse gain control with respect to each of the transport channels 17. The audio decoding device 24 may parse the determined number of bits allocated for each of the transport channels 17 from the bitstream 21 to extract each of the transport channels 17 from the bitstream 21 (1204).

The audio decoding device 24 may decompress the transport channels 17 to generate a spatially compressed version of HOA audio data 11 (1206). That is, the audio decoding device 24 may perform psychoacoustic decoding with respect to the transport channels 17 to generate the spatially compressed version of HOA audio data 11. The audio decoding device 24 may output the spatially compressed version of the HOA audio data 11 to audio renderers 22 (or alternatively perform spatial decompression with respect to the spatially compressed version of the HOA audio data 11 to obtain HOA coefficients 11', which are then provided to the audio renderers 22). In either event, the audio renders 22 may render, based on the spatially compressed version of the HOA audio data 11, spatial domain speaker feeds 25 (1208). The audio renderers 22 may output the spatial domain speaker feeds 25 to one or more speakers 3 (1210).

3D audio coding, described in detail above, may include a novel scene-based audio HOA representation format that may be designed to overcome some limitations of traditional audio coding. Scene based audio may represent the three dimensional sound scene (or equivalently the pressure field) using a very efficient and compact set of signals known as higher order ambisonic (HOA) based on spherical harmonic basis functions.

In some instances, content creation may be closely tied to how the content will be played back. The scene based audio format (such as those defined in the above referenced MPEG-H 3D audio standard) may support content creation of one single representation of the sound scene regardless of the system that plays the content. In this way, the single representation may be played back on a 5.1, 7.1, 7.4.1, 11.1, 22.2, etc. playback system. Because the representation of the sound field may not be tied to how the content will be played back (e.g. over stereo or 5.1 or 7.1 systems), the scene-based audio (or, in other words, HOA) representation is designed to be played back across all playback scenarios. The scene-based audio representation may also be amenable for both live capture and for recorded content and may be engineered to fit into existing infrastructure for audio broadcast and streaming as described above.

Although described as a hierarchical representation of a soundfield, the HOA coefficients may also be characterized as a scene-based audio representation. As such, the mezzanine compression or encoding may also be referred to as a scene-based compression or encoding.

The scene based audio representation may offer several value propositions to the broadcast industry, such as the following:

- Potentially easy capture of live audio scene: Signals captured from microphone arrays and/or spot microphones may be converted into HOA coefficients in real time.
- Potentially flexible rendering: Flexible rendering may allow for the reproduction of the immersive auditory scene regardless of speaker configuration at playback location and on headphones.
- Potentially minimal infrastructure upgrade: The existing infrastructure for audio broadcast that is currently employed for transmitting channel based spatial audio (e.g. 5.1 etc.) may be leveraged without making any significant changes to enable transmission of HOA representation of the sound scene.

In addition, the foregoing techniques may be performed with respect to any number of different contexts and audio ecosystems and should not be limited to any of the contexts or audio ecosystems described above. A number of example contexts are described below, although the techniques should be limited to the example contexts. One example audio ecosystem may include audio content, movie studios, music studios, gaming audio studios, channel based audio content, coding engines, game audio stems, game audio coding/rendering engines, and delivery systems.

The movie studios, the music studios, and the gaming audio studios may receive audio content. In some examples, the audio content may represent the output of an acquisition. The movie studios may output channel based audio content (e.g., in 2.0, 5.1, and 7.1) such as by using a digital audio workstation (DAW). The music studios may output channel based audio content (e.g., in 2.0, and 5.1) such as by using a DAW. In either case, the coding engines may receive and encode the channel based audio content based one or more codecs (e.g., AAC, AC3, Dolby True HD, Dolby Digital Plus, and DTS Master Audio) for output by the delivery systems. The gaming audio studios may output one or more game audio stems, such as by using a DAW. The game audio coding/rendering engines may code and or render the audio stems into channel based audio content for output by the delivery systems. Another example context in which the techniques may be performed comprises an audio ecosystem that may include broadcast recording audio objects, professional audio systems, consumer on-device capture, HOA audio format, on-device rendering, consumer audio, TV, and accessories, and car audio systems.

The broadcast recording audio objects, the professional audio systems, and the consumer on-device capture may all code their output using HOA audio format. In this way, the audio content may be coded using the HOA audio format into a single representation that may be played back using the on-device rendering, the consumer audio, TV, and accessories, and the car audio systems. In other words, the single representation of the audio content may be played back at a generic audio playback system (i.e., as opposed to requiring a particular configuration such as 5.1, 7.1, etc.), such as audio playback system 16.

Other examples of context in which the techniques may be performed include an audio ecosystem that may include acquisition elements, and playback elements. The acquisition elements may include wired and/or wireless acquisition devices (e.g., Eigen microphones), on-device surround sound capture, and mobile devices (e.g., smartphones and tablets). In some examples, wired and/or wireless acquisition devices may be coupled to mobile device via wired and/or wireless communication channel(s).

In accordance with one or more techniques of this disclosure, the mobile device may be used to acquire a soundfield. For instance, the mobile device may acquire a soundfield via the wired and/or wireless acquisition devices and/or the on-device surround sound capture (e.g., a plurality of microphones integrated into the mobile device). The mobile device may then code the acquired soundfield into the HOA coefficients for playback by one or more of the playback elements. For instance, a user of the mobile device may record (acquire a soundfield of) a live event (e.g., a meeting, a conference, a play, a concert, etc.), and code the recording into HOA coefficients.

The mobile device may also utilize one or more of the playback elements to playback the HOA coded soundfield. For instance, the mobile device may decode the HOA coded soundfield and output a signal to one or more of the playback elements that causes the one or more of the playback elements to recreate the soundfield. As one example, the mobile device may utilize the wireless and/or wireless communication channels to output the signal to one or more speakers (e.g., speaker arrays, sound bars, etc.). As another example, the mobile device may utilize docking solutions to output the signal to one or more docking stations and/or one or more docked speakers (e.g., sound systems in smart cars and/or homes). As another example, the mobile device may utilize headphone rendering to output the signal to a set of headphones, e.g., to create realistic binaural sound.

In some examples, a particular mobile device may both acquire a 3D soundfield and playback the same 3D soundfield at a later time. In some examples, the mobile device may acquire a 3D soundfield, encode the 3D soundfield into HOA, and transmit the encoded 3D soundfield to one or more other devices (e.g., other mobile devices and/or other non-mobile devices) for playback.

Yet another context in which the techniques may be performed includes an audio ecosystem that may include audio content, game studios, coded audio content, rendering engines, and delivery systems. In some examples, the game studios may include one or more DAWs which may support editing of HOA signals. For instance, the one or more DAWs may include HOA plugins and/or tools which may be configured to operate with (e.g., work with) one or more game audio systems. In some examples, the game studios may output new stem formats that support HOA. In any case, the game studios may output coded audio content to the rendering engines which may render a soundfield for playback by the delivery systems.

The techniques may also be performed with respect to exemplary audio acquisition devices. For example, the techniques may be performed with respect to an Eigen microphone which may include a plurality of microphones that are collectively configured to record a 3D soundfield. In some examples, the plurality of microphones of Eigen microphone may be located on the surface of a substantially spherical ball with a radius of approximately 4 cm. In some examples, the audio encoding device 20 may be integrated into the Eigen microphone so as to output a bitstream 21 directly from the microphone.

Another exemplary audio acquisition context may include a production truck which may be configured to receive a signal from one or more microphones, such as one or more Eigen microphones. The production truck may also include an audio encoder, such as audio encoder 20 of FIG. 5.

The mobile device may also, in some instances, include a plurality of microphones that are collectively configured to record a 3D soundfield. In other words, the plurality of microphone may have X, Y, Z diversity. In some examples, the mobile device may include a microphone which may be rotated to provide X, Y, Z diversity with respect to one or more other microphones of the mobile device. The mobile device may also include an audio encoder, such as audio encoder 20 of FIG. 5.

A ruggedized video capture device may further be configured to record a 3D soundfield. In some examples, the ruggedized video capture device may be attached to a helmet of a user engaged in an activity. For instance, the ruggedized video capture device may be attached to a helmet of a user whitewater rafting. In this way, the ruggedized video capture device may capture a 3D soundfield that represents the action all around the user (e.g., water crashing behind the user, another rafter speaking in front of the user, etc. . . . ).

The techniques may also be performed with respect to an accessory enhanced mobile device, which may be configured to record a 3D soundfield. In some examples, the mobile device may be similar to the mobile devices discussed above, with the addition of one or more accessories. For instance, an Eigen microphone may be attached to the above noted mobile device to form an accessory enhanced mobile device. In this way, the accessory enhanced mobile device may capture a higher quality version of the 3D soundfield than just using sound capture components integral to the accessory enhanced mobile device.

Example audio playback devices that may perform various aspects of the techniques described in this disclosure are further discussed below. In accordance with one or more techniques of this disclosure, speakers and/or sound bars may be arranged in any arbitrary configuration while still playing back a 3D soundfield. Moreover, in some examples, headphone playback devices may be coupled to a decoder 24 via either a wired or a wireless connection. In accordance with one or more techniques of this disclosure, a single generic representation of a soundfield may be utilized to render the soundfield on any combination of the speakers, the sound bars, and the headphone playback devices.

A number of different example audio playback environments may also be suitable for performing various aspects of the techniques described in this disclosure. For instance, a 5.1 speaker playback environment, a 2.0 (e.g., stereo) speaker playback environment, a 9.1 speaker playback environment with full height front loudspeakers, a 22.2 speaker playback environment, a 16.0 speaker playback environment, an automotive speaker playback environment, and a mobile device with ear bud playback environment may be suitable environments for performing various aspects of the techniques described in this disclosure.

In accordance with one or more techniques of this disclosure, a single generic representation of a soundfield may be utilized to render the soundfield on any of the foregoing playback environments. Additionally, the techniques of this disclosure enable a rendered to render a soundfield from a generic representation for playback on the playback environments other than that described above. For instance, if design considerations prohibit proper placement of speakers according to a 7.1 speaker playback environment (e.g., if it is not possible to place a right surround speaker), the techniques of this disclosure enable a render to compensate with the other 6 speakers such that playback may be achieved on a 6.1 speaker playback environment.

Moreover, a user may watch a sports game while wearing headphones. In accordance with one or more techniques of this disclosure, the 3D soundfield of the sports game may be acquired (e.g., one or more Eigen microphones may be placed in and/or around the baseball stadium), HOA coefficients corresponding to the 3D soundfield may be obtained and transmitted to a decoder, the decoder may reconstruct the 3D soundfield based on the HOA coefficients and output the reconstructed 3D soundfield to a renderer, the renderer may obtain an indication as to the type of playback environment (e.g., headphones), and render the reconstructed 3D soundfield into signals that cause the headphones to output a representation of the 3D soundfield of the sports game.

In each of the various instances described above, it should be understood that the audio encoding device 20 may perform a method or otherwise comprise means to perform each step of the method for which the audio encoding device 20 is configured to perform In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio encoding device 20 has been configured to perform.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media. Data storage media may be any available media that can be accessed by one or more computers or one or more processors to retrieve instructions, code and/or data structures for implementation of the techniques described in this disclosure. A computer program product may include a computer-readable medium.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

Moreover, as used herein, "A and/or B" means "A or B", or both "A and B."

Various aspects of the techniques have been described. These and other aspects of the techniques are within the scope of the following claims.

The invention claimed is:

1. A device configured to compress higher-order ambisonic (HOA) audio data representative of a soundfield, the device comprising:

a memory configured to store a spatially compressed version of the HOA audio data; and one or more processors coupled to the memory, and configured to:

perform bitrate allocation, based on an analysis of transport channels representative of the spatially compressed version of the HOA audio data, and prior to performing gain control with respect to the transport channels or after performing inverse gain control with respect to the transport channels, to allocate a number of bits to each of the transport channels; and generate a bitstream that specifies each of the transport channels using the respective allocated number of bits.

2. The device of claim 1, wherein the one or more processors are further configured to:

render the transport channels from a spherical harmonic domain to spatial domain channels; and perform the analysis with respect to the spatial domain channels.

3. The device of claim 1, wherein the one or more processors are further configured to:

render the transport channels from a spherical harmonic domain to uniformly distributed spatial domain channels; and perform the analysis with respect to the uniformly distributed spatial domain channels.

4. The device of claim 1, wherein the analysis comprises an energy-based analysis of the transport channels.

5. The device of claim 1, wherein the analysis comprises a perceptual-based analysis of the transport channels.

6. The device of claim 1, wherein the analysis comprises a directional-based weighting analysis of the transport channels.

7. The device of claim 1, wherein the analysis comprises a directional-based weighting analysis and a perceptual-based analysis of the transport channels.

8. The device of claim 1, wherein the one or more processors are further configured to perform the inverse gain control with respect to the transport channels to remove gain normalization applied to the transport channels prior to performing the analysis of the transport channels.

9. The device of claim 1, further comprising a microphone coupled to the one or more processors, and configured to capture signals representative of the HOA audio data.

10. The device of claim 9, wherein the one or more processors are further configured to perform spatial compression with respect to the HOA audio data to generate the spatially compressed version of the HOA audio data.

11. The device of claim 9, wherein the one or more processors are configured to perform a linear invertible decomposition with respect to the HOA audio data so as to generate the spatially compressed version of the HOA audio data.

12. The device of claim 1, wherein the spatially compressed version of the HOA audio data includes a predominant audio signal defined in a spherical harmonic domain, and a corresponding spatial component defining a direction, a shape, and a width of the predominant audio signal, the spatial component also defined in the spherical harmonic domain.

13. The device of claim 1, wherein the device comprises a robot.

14. The device of claim 1, wherein the device comprises an automobile.

15. A method of compressing higher-order ambisonic (HOA) audio data representative of a soundfield, the method comprising:

performing bitrate allocation, based on an analysis of transport channels representative of a spatially compressed version of the HOA audio data, and prior to performing gain control with respect to the transport channels or after performing inverse gain control with respect to the transport channels, to allocate a number of bits to each of the transport channels; and generating a bitstream that specifies each of the transport channels using the respective allocated number of bits.

16. The method of claim 15, further comprising:

rendering the transport channels from a spherical harmonic domain to spatial domain channels; and performing the analysis with respect to the spatial domain channels.

17. The method of claim 15, further comprising:

rendering the transport channels from a spherical harmonic domain to uniformly distributed spatial domain channels; and performing the analysis with respect to the uniformly distributed spatial domain channels.

18. The method of claim 15, wherein the analysis comprises an energy-based analysis of the transport channels.

19. The method of claim 15, wherein the analysis comprises a perceptual-based analysis of the transport channels.

20. The method of claim 15, wherein the analysis comprises a directional-based weighting analysis of the transport channels.

21. The method of claim 15, wherein the analysis comprises a directional-based weighting analysis and a perceptual-based analysis of the transport channels.

22. The method of claim 15, further comprising performing the inverse gain control with respect to the transport channels to remove gain normalization applied to the transport channels prior to performing the analysis of the transport channels.

23. The method of claim 15, further comprising capturing, by a microphone, signals representative of the HOA audio data.

24. The method of claim 23, further comprising performing spatial compression with respect to the HOA audio data to generate the spatially compressed version of the HOA audio data.

25. The method of claim 23, further comprising performing a linear invertible decomposition with respect to the HOA audio data so as to generate the spatially compressed version of the HOA audio data.

26. The method of claim 15, wherein the spatially compressed version of the HOA audio data includes a predominant audio signal defined in a spherical harmonic domain, and a corresponding spatial component defining a direction, a shape, and a width of the predominant audio signal, the spatial component also defined in the spherical harmonic domain.

27. The device of claim 15, wherein performing the bitrate allocation comprises performing, by one or more processors of a device, the bitrate allocation, wherein generating the bitstream comprises generating, by the one or more processors, the bitstream, and wherein the device comprises a mobile communication handset.

28. The device of claim 15, wherein performing the bitrate allocation comprises performing, by one or more processors of a device, the bitrate allocation, wherein generating the bitstream comprises generating, by the one or more processors, the bitstream, and wherein the device comprises a robot.

29. A device configured to compress higher-order ambisonic (HOA) audio data representative of a soundfield, the device comprising:

means for performing bitrate allocation, based on an analysis of transport channels representative of a spatially compressed version of the HOA audio data, and prior to performing gain control with respect to the transport channels or after performing inverse gain control with respect to the transport channels, to allocate a number of bits to each of the transport channels; and means for generating a bitstream that specifies each of the transport channels using the respective allocated number of bits.

30. A non-transitory computer-readable storage medium having stored thereon instructions that, when executed, cause one or more processors to:

perform bitrate allocation, based on an analysis of transport channels representative of a spatially compressed version of higher-order ambisonic (HOA) audio data, and prior to performing gain control with respect to the transport channels or after performing inverse gain control with respect to the transport channels, to allocate a number of bits to each of the transport channels; and generate a bitstream that specifies each of the transport channels using the respective allocated number of bits.

* * * * *